US010876351B2

(12) United States Patent
Fields, I

(10) Patent No.: US 10,876,351 B2
(45) Date of Patent: Dec. 29, 2020

(54) DOOR REINFORCEMENT APPARATUS

(71) Applicant: iVault Home Protection, LLC, Stockbridge, GA (US)

(72) Inventor: Freeman Fields, I, Atlanta, GA (US)

(73) Assignee: iVault Home Protection, LLC, Stockbridge, GA (US)

( * ) Notice: Subject to any disclaimer, the term of this patent is extended or adjusted under 35 U.S.C. 154(b) by 0 days.

(21) Appl. No.: 16/126,451

(22) Filed: Sep. 10, 2018

(65) Prior Publication Data

US 2019/0003247 A1 Jan. 3, 2019

Related U.S. Application Data

(63) Continuation of application No. 15/800,640, filed on Nov. 1, 2017, now abandoned.

(60) Provisional application No. 62/496,865, filed on Nov. 1, 2016.

(51) Int. Cl.

| | |
|---|---|
| ***E06B 5/11*** | (2006.01) |
| ***E05D 11/00*** | (2006.01) |
| ***E05B 15/02*** | (2006.01) |
| ***E05B 17/20*** | (2006.01) |

(52) U.S. Cl.

CPC ..... *E06B 5/113* (2013.01); *E05B 15/0205* (2013.01); *E05B 17/2084* (2013.01); *E05D 11/0018* (2013.01)

(58) Field of Classification Search

CPC .. E06B 5/113; E05B 17/2003; E05B 17/2084; E05B 15/02; E05B 15/0205; E05D 11/0018

See application file for complete search history.

(56) References Cited

U.S. PATENT DOCUMENTS

| | | | | | |
|---|---|---|---|---|---|
| 4,415,191 | A * | 11/1983 | Thorp | E05B 15/0205 | 292/340 |
| 4,673,204 | A * | 6/1987 | Allenbaugh | E05B 17/2084 | 292/337 |
| 4,887,856 | A * | 12/1989 | Percoco | E05B 9/08 | 292/337 |
| 4,953,901 | A * | 9/1990 | Hegdahl | E05B 15/0205 | 292/340 |
| 5,586,796 | A * | 12/1996 | Fraser | E05B 15/0205 | 292/340 |
| 6,154,926 | A * | 12/2000 | Formiller | E05D 5/04 | 16/382 |
| 6,679,004 | B1 * | 1/2004 | Olberding | E05B 15/0205 | 49/460 |
| 8,904,713 | B1 * | 12/2014 | Anderson | E05B 17/2084 | 292/340 |
| 2002/0092258 | A1 * | 7/2002 | Rochman | E05B 17/2084 | 52/630 |

(Continued)

*Primary Examiner* — Gregory J Strimbu
(74) *Attorney, Agent, or Firm* — Innovators Legal

(57) ABSTRACT

An apparatus that can be installed on an existing door to provide improved security. The apparatus has first and second door brackets that are installed on the interior and exterior surfaces of the door, respectively, and together increase the strength of the door in the region near the door handle and/or deadbolt. The apparatus also has a door frame bar that is installed on the door frame opposing a vertical outside edge of the door and one or more door hinge bars that are mounted on the interior surface of the door near one or more door hinges. The apparatus can optionally have a reinforcing bar.

14 Claims, 21 Drawing Sheets

(56) References Cited

U.S. PATENT DOCUMENTS

| | | | | |
|---|---|---|---|---|
| 2003/0029093 | A1* | 2/2003 | Childress | B60J 5/042 49/462 |
| 2005/0011132 | A1* | 1/2005 | Griffin, Jr. | E05B 9/002 49/460 |
| 2013/0270844 | A1* | 10/2013 | Berger | E05B 1/003 292/336.3 |
| 2015/0218878 | A1* | 8/2015 | Olberding | E06B 7/16 49/394 |

* cited by examiner

DOOR REINFORCEMENT APPARATUS

CROSS-REFERENCE TO RELATED APPLICATIONS

This Application claims the benefit of is a continuation application of co-pending of U.S. application Ser. No. 15/800,640, filed Nov. 1, 2017, which claims the benefit of U.S. Provisional Application No. 62/496,865, filed on Nov. 1, 2016, each of which is incorporated herein by reference in its entirety.

TECHNICAL FIELD

This technology relates to kits and devices for door reinforcement comprising metal bars and decorative metal brackets that are placed on the door of a home to prevent it from being forcibly entered by a burglar or criminal. The metal bars and decorative metal brackets can easily convert a standard door into the same integrity and strength of a security door by reinforcing the weak points of the door.

BACKGROUND

Probably since the first home was built in the US, there has always been the threat of burglary and the search to prevent it. The overall population growth also brought about the expediential increase in crime. Many home alarm and security companies have capitalized on the need for protection. The use of technology is one of the many means to combat home invasions.

The demand for protection is so great that the home alarm and security industry has become a multi-billion dollar a year industry. The traditional form of home protection is a home alarm that alerts the homeowner of a potential intruder. The problem with traditional home alarms is they are only designed to alert of a crime, not to intervene to prevent the crime from taking place. They are only to be used as a deterent. However, with the average response time to an alarm being approximately ten to fifteen minutes, criminals are no longer afraid of getting caught during a burglary, making the alarm in effective.

Other means of protection included installing security bars on the doors and windows, gated security doors, steel doors and other bulky metal products to prevent someone from entering the home. The problem with these means of protection is that they are usually very expensive, intrusive, unattractive, a fire hazard, violate city & association codes, reduce the value of the home by projecting an unsafe neighborhood and are simply undesirable. Also, criminals have resorted to prying the bars from the door or wall structure to gain access to the home.

This invention is a solution to these problems. It is seamlessly placed on the door and practically hidden out of site while making the door resistant to forceful entry.

SUMMARY

In accordance with the purpose(s) of the disclosure, as embodied and broadly described herein, the disclosure, in one aspect, relates to an apparatus and kits for improved door security. In an aspect, the disclosed apparatus provides seamless installation of a first and a second door bracket, one or more door hinge bars, and a door frame bar that strengthen the weak areas of the door near the lock and hinges. In particular, the disclosed apparatus and kit can be seamlessly installed on an existing door to improve the security of the door.

Disclosed is an apparatus for securing a door, the apparatus comprising: at least one door hinge bar comprising a plurality of holes therein for receiving a fastener, wherein the at least one door hinge bars is secured to an interior surface of the door near a door hinge; a first door bracket comprising a plurality of holes therein for receiving a fastener, wherein the first door bracket is secured and flush to an interior surface of the door and positioned near a door handle assembly, a deadbolt assembly, or both a door handle assembly and a deadbolt assembly; a second door bracket comprising a plurality of holes therein for receiving a fastener, wherein the second door bracket is secured and flush to an exterior surface of the door and positioned near a door handle assembly, a deadbolt assembly, or both a door handle assembly and a deadbolt assembly; and a door frame bar comprising a plurality of holes therein for receiving a fastener and at least one knockout plate, wherein the door frame bar is secured and flush to a door frame in a position opposing in part a deadbolt, wherein the at least one knockout plate is removed before securing to the door frame to provide at least one opening in the door frame bar, and wherein the door frame bar is positioned on the door frame such that the at least one opening is positioned over the receiving hole for the bolt of the deadbolt or the latch of the deadlatch.

Also disclosed herein are kits comprising the disclosed apparatus and instructions for installation of the apparatus on a door and associated door frame.

While aspects of the present disclosure can be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

BRIEF DESCRIPTION OF THE FIGURES

The accompanying figures, which are incorporated in and constitute a part of this specification, illustrate several aspects and together with the description serve to explain the principles of the disclosure.

FIG. 1A shows a representative front view of a door frame bar with knockout plates. FIG. 1B a representative front view of a disclosed door frame bar with knockout plates removed and thereby provide door frame bar openings. FIG. 1C shows a representative cross-sectional side view of a disclosed door frame bar. FIG. 1D shows a fragmentary representative cross-sectional side view of a disclosed door frame hole with countersink flanges and screw.

FIG. 3A shows a representative front view of a disclosed door bracket. FIG. 3B shows a representative front view of an alternative disclosed door bracket. FIG. 3C shows a representative front view of a further disclosed door bracket. FIG. 3D shows a representative front view of yet a further disclosed door bracket. FIG. 3E shows a representative cross-sectional side-view of the disclosed door bracket shown in FIG. 3B. FIG. 3F shows an alternative respresentative cross-sectional side-view of the disclosed door bracket shown in FIG. 3B in which the door bracket screw holes are counter-sunk. FIG. 3G shows a fragmentary representative cross-sectional side view of a disclosed door bracket hole with countersink flanges and screw.

FIG. 5A shows the door bracket of FIG. 2B relative on interior portion of a door relative to a deadbolt and door handle assemblies. FIG. 5B shows the door bracket of FIG. 2B relative on interior portion of a door relative to a deadbolt and door handle assemblies, and further comprising a reinforcing bar and reinforcing bar opening.

FIG. 6A shows placement of a disclosed door bracket on each of the interior and exterior portions of a door relative to a deadbolt and deadlatch, along with placement of screws attaching the door bracket to the door. FIG. 6B shows placement of a door bracket on each of the interior and exterior portions of a door relative to a deadbolt and deadlatch, along with placement of screws attaching the door bracket to the door and of the reinforcing bar.

Figure 1A:
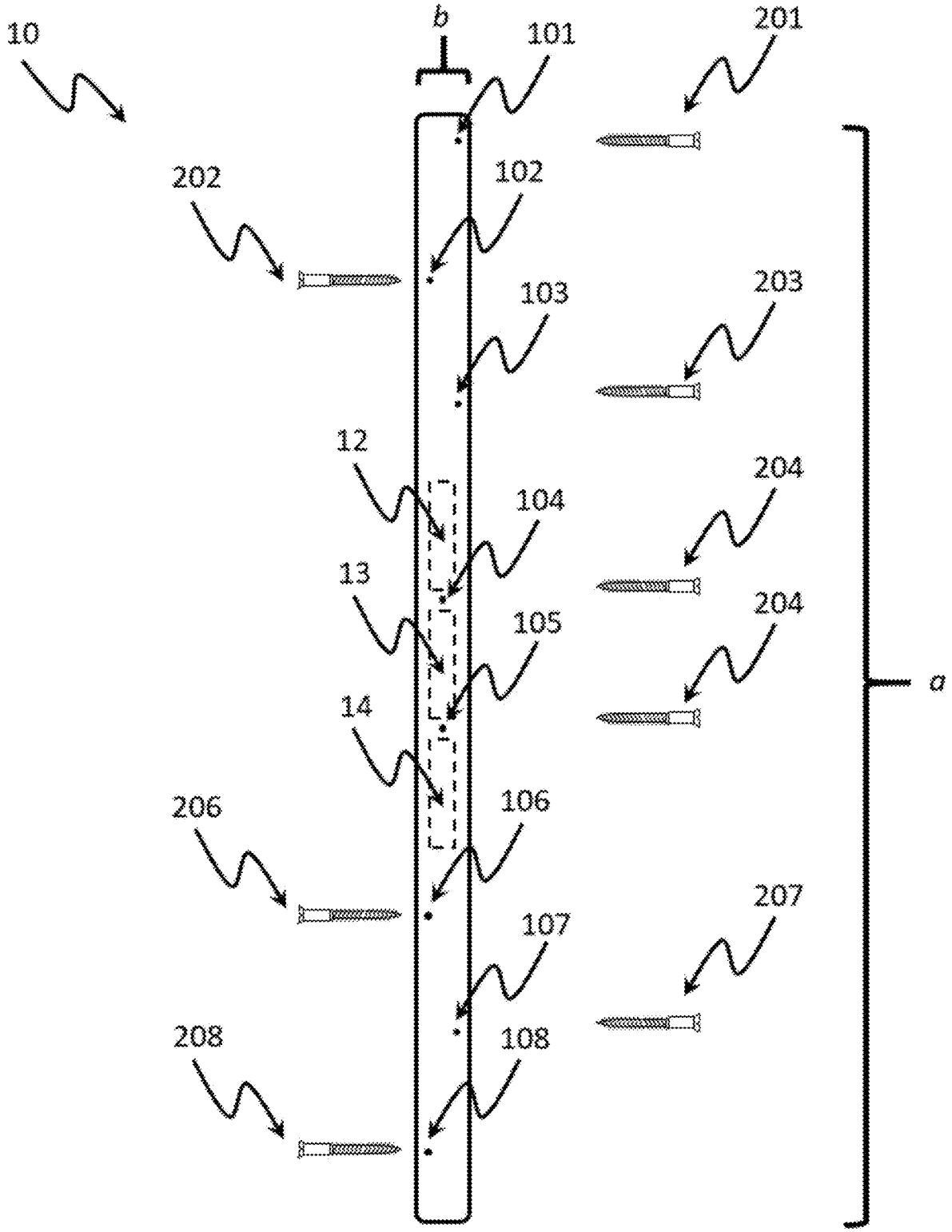
FIGS. 1A-1D show representative views of a disclosed door frame bar.

Additional advantages of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

The disclosures herein will be described more fully hereinafter with reference to the accompanying drawings, in which some, but not all possible embodiments are shown. Indeed, disclosures may be embodied in many different forms and should not be construed as limited to the embodiments set forth herein; rather, these embodiments are provided so that this disclosure will satisfy applicable legal requirements. Like numbers refer to like elements throughout.

Many modifications and other embodiments disclosed herein will come to mind to one skilled in the art to which the disclosed compositions and methods pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. Although specific terms are employed herein, they are used in a generic and descriptive sense only and not for purposes of limitation.

It is also to be understood that the terminology used herein is for the purpose of describing particular aspects only and is not intended to be limiting.

As used herein, "comprising" is to be interpreted as specifying the presence of the stated features, integers, steps, or components as referred to, but does not preclude the presence or addition of one or more features, integers, steps, or components, or groups thereof. Additionally, the term "comprising" is intended to include examples encompassed by the terms "consisting essentially of" and "consisting of." Similarly, the term "consisting essentially of" is intended to include examples encompassed by the term "consisting of."

Unless defined otherwise, all technical and scientific terms used herein have the same meaning as commonly understood by one of ordinary skill in the art to which the disclosed compositions and methods belong. In this specification and in the claims which follow, reference will be made to a number of terms which shall be defined herein.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

As used in the specification and the appended claims, the singular forms "a," "an" and "the" include plural referents unless the context clearly dictates otherwise. Thus, for example, reference to "a screw," "a screw hole," or "a door hinge bar" includes mixtures of two or more such screws, screw holes, or door hinge bars, and the like.

It should be noted that ratios, dimensions, amounts, and other numerical data can be expressed herein in a range format. Where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'". It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., 1%, 2%, 3%, and 4%) and the sub-ranges (e.g., 0.5%, 1.1%, 2.4%, 3.2%, and 4.4%) within the indicated range.

As used herein, the terms "about," "approximate," "at or about," and "substantially" mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In such cases, it is generally understood, as used herein, that "about" and "at or about" mean the nominal value indicated ±10% variation unless otherwise indicated or inferred. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

As used herein, the terms "optional" or "optionally" means that the subsequently described event or circumstance can or can not occur, and that the description includes instances where said event or circumstance occurs and instances where it does not.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of embodiments described in the specification.

The shapes, sizes, dimensions, positioning, and number of elements depicted in the figures are meant for exemplary purposes only. Alternative shapes, sizes, dimensions, positioning, and number of elements, including duplicate elements, are contemplated by and within embodiments of the present disclosure.

For convenience, the indicia reference numbers used in the figures and discussion herein are summarized in Table 1 below.

TABLE 1

| Indicia No. | Term | Description |
|---|---|---|
| 1 | door handle assembly | door handle, comprising the interior and exterior door knobs, the door handle deadlatch, cylinder (e.g., a 6-pin cylinder), trim ring and insert, and other standard hardware or components as required and typically found for installation on a standard exterior door |
| 2 | deadbolt assembly | deadbolt comprising the deadbolt, cylinder (e.g., a 5-pin cylinder), cylinder housing, trim ring and insert, interior escutcheon or cylinder, and other standard hardware or components as required and typically found for installation on a standard exterior door |
| 3 | door | refers to a complete door, or a portion thereof; the door can be of any conventional exterior design comprising one or more panel components optionally comprising one or more windows. |
| 4 | door frame | frame surrounding the door opening comprising structural and decorative components |
| 5 | wall | |
| 6 | hinge | a hinge as commonly found on a standard door |
| 8 | deadbolt | deadbolt component of the deadbolt assembly |
| 9 | deadlatch | deadlatch component of the door handle assembly |
| 10 | door frame bar | mounted on the door frame that is located opposite the edge of the door with the lockset and handle; in the aspect displayed, the knockout plates, 12, 13, and 14, are present in the door frame bar |
| 11 | door frame bar | the door frame bar is mounted on the door frame opposing the edge of the door with the lockset and handle; in the aspect displayed, the knockout plates, 12, 13, and 14, have been removed to provide door frame bar openings 15, 16, and 17. |
| 12 | door frame bar knock-out plate | a rectangular, square, or trapezoidal shape that is a partially stamped opening, or alternatively, a partly formed opening, in the door frame bar comprising a blank closing the openings can |

TABLE 1-continued

| Indicia No. | Term | Description |
|---|---|---|
| | | be easily punched outwardly to complete an opening, 15, through the door frame bar |
| 13 | door frame bar knock-out plate | a rectangular, square, or trapezoidal shape that is a partially stamped opening, or alternatively, a partly formed opening, in the door frame bar comprising a blank closing the openings can be easily punched outwardly to complete an opening, 16, through the door frame bar |
| 14 | door frame bar knock-out plate | a rectangular, square, or trapezoidal shape that is a partially stamped opening, or alternatively, a partly formed opening, in the door frame bar comprising a blank closing the openings can be easily punched outwardly to complete an opening, 17, through the door frame bar |
| 15 | door frame bar opening | a rectangular, square, or trapezoidal opening that remains in the door frame bar after the door frame knock-out plate, 12, is removed |
| 16 | door frame bar opening | a rectangular, square, or trapezoidal opening that remains in the door frame bar after the door frame knock-out plate, 13, is removed |
| 17 | door frame bar opening | a rectangular, square, or trapezoidal opening that remains in the door frame bar after the door frame knock-out plate, 14, is removed |
| 20 | door hinge bar | a bar comprising a plurality of screw holes, e.g., door hinge bar screw holes 301-304, that is positioned on a interior surface of the door, 3, centered over the area occupied by a hinge portion attached to the door |
| 101 | door frame bar screw hole | a hole of suitable diameter to accept a screw, 201, wherein the hole is continuous form the front surface of the door frame bar to the rear surface of the door frame bar; the cross-sectional edges of the hole can be perpendicular or beveled relative to the front or rear surface of the door frame bar |
| 102 | door frame bar screw hole | a hole of suitable diameter to accept a screw, 202, wherein the hole is continuous form the front surface of the door frame bar to the rear surface of the door frame bar; the cross-sectional edges of the hole can be perpendicular or beveled relative to the front or rear surface of the door frame bar |
| 103 | door frame bar screw hole | a hole of suitable diameter to accept a screw, 203, wherein the hole is continuous form the front surface of the door frame bar to the rear surface of the door frame bar; the cross-sectional edges of the hole can be perpendicular or beveled relative to the front or rear surface of the door frame bar |
| 104 | door frame bar screw hole | a hole of suitable diameter to accept a screw, 204, wherein the hole is continuous form the front surface of the door frame bar to the rear surface of the door frame bar; the cross-sectional edges of the hole can be perpendicular or beveled relative to the front or rear surface of the door frame bar |
| 105 | door frame bar screw hole | a hole of suitable diameter to accept a screw, 205, wherein the hole is continuous form the front surface of the door frame bar to the rear surface of the door frame bar; the cross-sectional edges of the hole can be perpendicular or beveled relative to the front or rear surface of the door frame bar |
| 106 | door frame bar screw hole | a hole of suitable diameter to accept a screw, 206, wherein the hole is continuous form the front surface of the door frame bar to the rear surface of the door frame bar; the cross-sectional edges of the hole can be perpendicular or beveled relative to the front or rear surface of the door frame bar |
| 107 | door frame bar screw hole | a hole of suitable diameter to accept a screw, 207, wherein the hole is continuous form the front surface of the door frame bar to the rear surface of the door frame bar; the cross-sectional edges of the hole can be perpendicular or beveled relative to the front or rear surface of the door frame bar |
| 108 | door frame bar screw hole | a hole of suitable diameter to accept a screw, 208, wherein the hole is continuous form the front surface of the door frame bar to the rear surface of the door frame bar; the cross-sectional edges of the hole can be perpendicular or beveled relative to the front or rear surface of the door frame bar |
| 120 | door frame bar screw hole countersink flange | a flange on the rear surface of a door frame bar screw hole, such as any one of door frame bar screw holes, 101-108, that is continous with the hole and formes an extension from the rear surface to provide additional thickness for a screw countersink. |
| 201 | door frame bar screw | a screw, such as a wood or machine screw, that is of a diameter to pass through the door frame bar screw hole, 101; the length can be from about 1/10 to 1/2 the thickness of the door |
| 202 | door frame bar screw | a screw, such as a wood or machine screw, that is of a diameter to pass through the door frame bar screw hole, 102; the length can be from about 1/10 to 1/2 the thickness of the door |

TABLE 1-continued

| Indicia No. | Term | Description |
|---|---|---|
| 203 | door frame bar screw | a screw, such as a wood or machine screw, that is of a diameter to pass through the door frame bar screw hole, 103; the length can be from about 1/10 to 1/2 the thickness of the door |
| 204 | door frame bar screw | a screw, such as a wood or machine screw, that is of a diameter to pass through the door frame bar screw hole, 104; the length can be from about 1/10 to 1/2 the thickness of the door |
| 205 | door frame bar screw | a screw, such as a wood or machine screw, that is of a diameter to pass through the door frame bar screw hole, 105; the length can be from about 1/10 to 1/2 the thickness of the door |
| 206 | door frame bar screw | a screw, such as a wood or machine screw, that is of a diameter to pass through the door frame bar screw hole, 106; the length can be from about 1/10 to 1/2 the thickness of the door |
| 207 | door frame bar screw | a screw, such as a wood or machine screw, that is of a diameter to pass through the door frame bar screw hole, 107; the length can be from about 1/10 to 1/2 the thickness of the door |
| 208 | door frame bar screw | a screw, such as a wood or machine screw, that is of a diameter to pass through the door frame bar screw hole, 108; the length can be from about 1/10 to 1/2 the thickness of the door |
| 301 | door hinge bar screw hole | a hole of suitable diameter to accept a screw, 401, wherein the hole is continuous form the front surface of the door frame bar to the rear surface of the door frame bar; the cross-sectional edges of the hole can be perpendicular or beveled relative to the front or rear surface of the door frame bar |
| 302 | door hinge bar screw hole | a hole of suitable diameter to accept a screw, 402, wherein the hole is continuous form the front surface of the door frame bar to the rear surface of the door frame bar; the cross-sectional edges of the hole can be perpendicular or beveled relative to the front or rear surface of the door frame bar |
| 303 | door hinge bar screw hole | a hole of suitable diameter to accept a screw, 403, wherein the hole is continuous form the front surface of the door frame bar to the rear surface of the door frame bar; the cross-sectional edges of the hole can be perpendicular or beveled relative to the front or rear surface of the door frame bar |
| 304 | door hinge bar screw hole | a hole of suitable diameter to accept a screw, 404, wherein the hole is continuous form the front surface of the door frame bar to the rear surface of the door frame bar; the cross-sectional edges of the hole can be perpendicular or beveled relative to the front or rear surface of the door frame bar |
| 401 | door hinge bar screw | a screw, such as a wood or machine screw, that is of a diameter to pass through the door frame bar screw hole, 301; the length can be from about 1/10 to 1/2 the thickness of the door |
| 402 | door hinge bar screw | a screw, such as a wood or machine screw, that is of a diameter to pass through the door frame bar screw hole, 302; the length can be from about 1/10 to 1/2 the thickness of the door |
| 403 | door hinge bar screw | a screw, such as a wood or machine screw, that is of a diameter to pass through the door frame bar screw hole, 303; the length can be from about 1/10 to 1/2 the thickness of the door |
| 404 | door hinge bar screw | a screw, such as a wood or machine screw, that is of a diameter to pass through the door frame bar screw hole, 304; the length can be from about 1/10 to 1/2 the thickness of the door |
| 501 | door bracket screw hole | a hole of suitable diameter to accept a screw, 601, wherein the hole is continuous form the front surface of the door frame bar to the rear surface of the door frame bar; the cross-sectional edges of the hole can be perpendicular or beveled relative to the front or rear surface of the door frame bar |
| 502 | door bracket screw hole | a hole of suitable diameter to accept a screw, 602, wherein the hole is continuous form the front surface of the door frame bar to the rear surface of the door frame bar; the cross-sectional edges of the hole can be perpendicular or beveled relative to the front or rear surface of the door frame bar |
| 503 | door bracket screw hole | a hole of suitable diameter to accept a screw, 603, wherein the hole is continuous form the front surface of the door frame bar to the rear surface of the door frame bar; the cross-sectional edges of the hole can be perpendicular or beveled relative to the front or rear surface of the door frame bar |
| 504 | door bracket screw hole | a hole of suitable diameter to accept a screw, 604, wherein the hole is continuous form the front surface of the door frame bar to the rear surface of the door frame bar; the cross-sectional edges of the hole can be perpendicular or beveled relative to the front or rear surface of the door frame bar |
| 505 | door bracket screw hole | a hole of suitable diameter to accept a screw, 605, wherein the hole is continuous form the front surface of the door frame bar to the rear surface of the door frame bar; the cross-sectional edges of the hole can be perpendicular or beveled relative to the front or rear surface of the door frame bar |
| 506 | door bracket screw hole | a hole of suitable diameter to accept a screw, 606, wherein the hole is continuous form the front surface of the door frame bar |

TABLE 1-continued

| Indicia No. | Term | Description |
|---|---|---|
| | | to the rear surface of the door frame bar; the cross-sectional edges of the hole can be perpendicular or beveled relative to the front or rear surface of the door frame bar |
| 520 | door bracket screw hole countersink flange | a flange on the rear surface of a door frame bar screw hole, such as any one of door frame bar screw holes, 501-506, that is continous with the hole and formes an extension from the rear surface to provide additional thickness for a screw countersink. |
| 601 | door bracket screw | a screw, such as a wood or machine screw, that is of a diameter to pass through the door frame bar screw hole, 501; the length can be from about 1/10 to ½ the thickness of the door |
| 602 | door bracket screw | a screw, such as a wood or machine screw, that is of a diameter to pass through the door frame bar screw hole, 502; the length can be from about 1/10 to ½ the thickness of the door |
| 603 | door bracket screw | a screw, such as a wood or machine screw, that is of a diameter to pass through the door frame bar screw hole, 503; the length can be from about 1/10 to ½ the thickness of the door |
| 604 | door bracket screw | a screw, such as a wood or machine screw, that is of a diameter to pass through the door frame bar screw hole, 504; the length can be from about 1/10 to ½ the thickness of the door |
| 605 | door bracket screw | a screw, such as a wood or machine screw, that is of a diameter to pass through the door frame bar screw hole, 505 the length can be from about 1/10 to ½ the thickness of the door |
| 606 | door bracket screw | a screw, such as a wood or machine screw, that is of a diameter to pass through the door frame bar screw hole, 506; the length can be from about 1/10 to ½ the thickness of the door |
| 700 | reinforcing bar | a bar of any suitable cross-sectional geometry (circular, square, and the like) that is friction fit into a opening, 701, in the door that is approximately centered in the vertical dimension relative the door brackets and also centered between the interior and exterior surfaces of the door |
| 701 | reinforcing bar opening | a cavity or space extending from the edge of the door inwards; it is centered in the vertical dimension relative to the door brackets and also centered between the interior and exterior surfaces of the door; the cross-sectional geometry is such that it will be complementary to the geometric cross-section of the reinforcing bar |
| 30-33 | door bracket | one door bracket is mounted on a interior surface of the door near a door edge proximal to the handle and/or lockset; a second door bracket is mounted on the exterior surface of the door parallel to the door bracket mounted on the interior surface of the door; a portion of the door bracket can optionally extend towards the interior of the door, and when present, the shape can be any suitable shape such as rectangular, square, trapezoidal, semi-circular, semi-ovoid, and the like; portions of the door bracket can have decorative elements stamped, painted, decaled, or cut-outs in the door bracket. |
| a | door frame bar-length dimension | the length of the door frame bar |
| b | door frame bar-width dimension | the width of the door frame bar |
| c | door frame bar-thickness dimension | the thickness of the door frame bar from a front surface to a rear surface of the door frame bar |
| d | door hinge bar-length dimension | the length of the door hinge bar |
| e | door hinge bar-width dimension | the width of the door hinge bar |
| g | door bracket-length dimension | the length of the door bracket |
| h | door bracket-width dimension | the width of the door bracket in the longest width dimension |
| i | door bracket-thickness dimension | the thickness of the door bracket |

In various aspects, the present disclosure relates to door security apparatus and kits comprising same. More specifically, embodiments of the present invention relate to an door security apparatus that can be installed on an existing door to strengthen typically weaker areas of the door that are prone to failure during a break-in by an intruder. In an aspect, the present disclosure pertains a door security apparatus comprising a door frame bar, 10; one or more door hinge bars, 20; and a door bracket, e.g., any one of door bracket 30-33. The door security apparatus can optionally further comprise a reinforcing bar, 700.

FIG. 1A depicts a front view of a representative door frame bar, 10, of the disclosed apparatus. The door frame bar, 10, can be fabricated, in various aspects, from steel, iron, aluminum, carbon-fiber materials, or a high-impact, high-tensile strength polymeric material. In a further aspect, the the door frame bar is fabricated from steel. The door frame bar can have unfinished surfaces, or alternatively, may be fabricated with a finish such as a paint coating, an anodized finish, or a polymeric coating. The intended meaning of the length, a, and width, b, dimensions are as indicated in the figure. The length dimension, a, of the door frame bar, 10, can be about 10 inches to about 60 inches. In an aspect, the length dimension, a, is about 35 to about 45 inches. In a further aspect, the length dimension, a, is about 40 inches. The width dimension, b, of the door frame bar, 10, can be about 0.5 to about 4 inches. In an aspect, the width dimension, b, of the door frame bar, 10, is about 1.5 inches to about 2.5 inches. In a further aspect, the width dimension, b, of the door frame bar, 10, is about 2.0 inches. The door frame bar is less than about ¼ inch thick.

The door frame bar, 10, is secured using a fastener to an interior face of a door frame and positioned approximately centered in the vertical and horizontal axes of the interior face of the door frame. The door frame bar comprises a plurality of door frame screw holes, e.g., from 2 to 16 holes. In an aspect, as shown in FIG. 1A, the door frame bar comprises eight door frame screw holes, 101-108. The holes are of a diameter to accept insertion of a fastener through the door frame hole.

In various aspects, the door frame bar, 10, further comprises a plurality of fasteners that can be inserted through the door frame holes to secure the door frame bar flush against an interior face of the door frame opposing a door edge, wherein a door knob assembly and/or door deadbolt assembly is positioned. In an aspect, as shown in FIG. 1A, the door frame bar comprises eight fasteners such as eight door frame screws, 201-208. The door frame bar screw can be any standard screw suitable for securing the door frame bar to an inner face of the door frame, such as a wood screw, sheet metal screw, or machine screw. The choice of screw type will depend upon the type of material from which the door frame is fabricated. In various aspects, the In an aspect, the wood screw or machine screw has a #2 to a #20 screw diameter per standard ANSI convention. The screw length can be appropriate for the door frame material and dimensions. In various aspects, the screw length is about 0.25 inches to about 6 inches.

In various aspects, the door frame bar, 10, comprises one or more knock-out plates. The knock-out plates, such as door frame bar knock-out plates 12, 13, and 14, as shown in FIG. 1A. The knock-out plates are positioned such that when removed (or "knocked out") the provide openings in the door frame bar. The openings can be approximately centered about the center in the length and width dimensions. The openings are located such that a bolt of a door deadbolt assembly and/or latch of a door handle assembly can pass through the door frame bar when installed on a door frame, and thereby move within the receive for each located in the door frame.

Figure 1B:
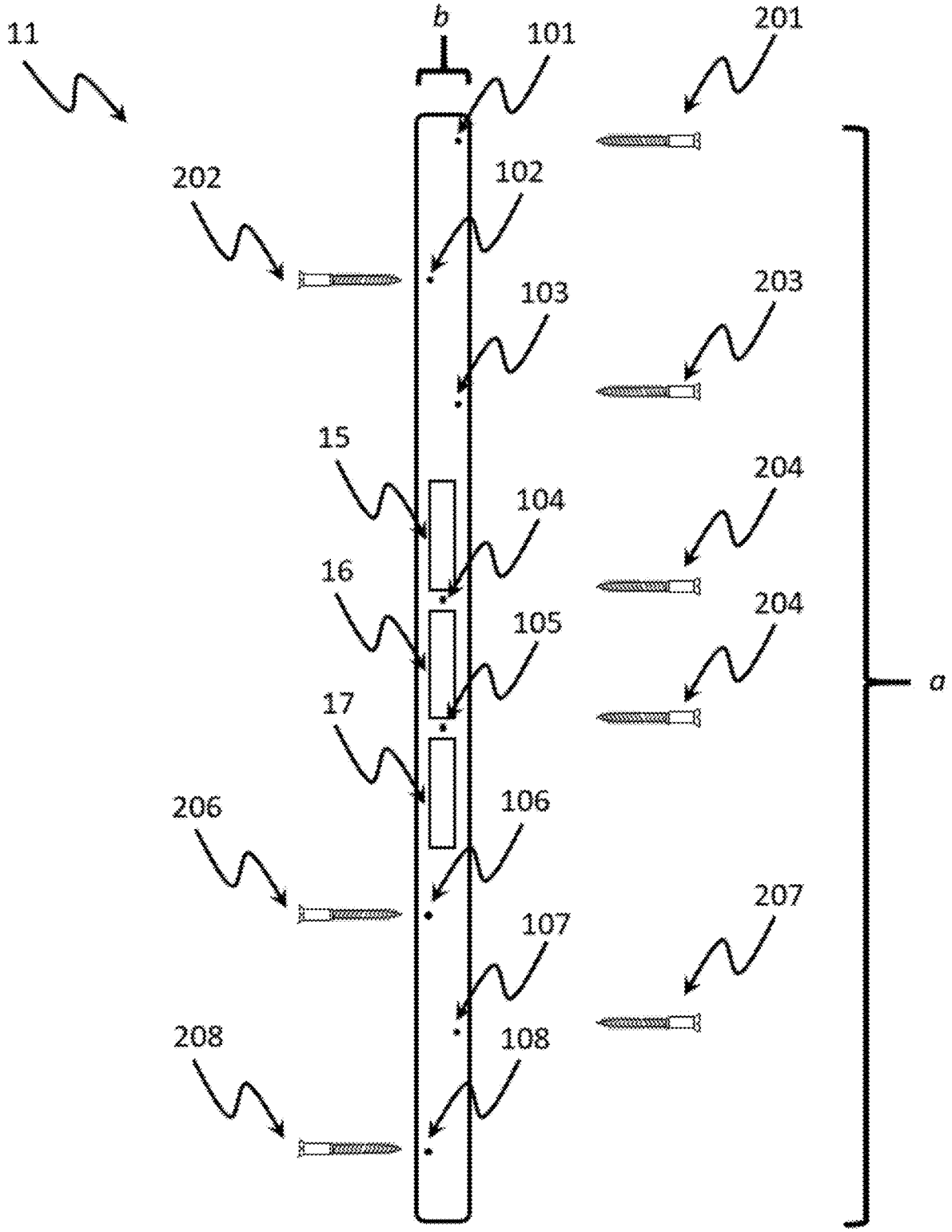

FIG. 1B shows a door frame bar, 11, corresponding to door frame bar, 10, wherein the knock-out plates have been removed to provide door frame bar openings, 15, 16, and 17, therein.

Figure 1C:
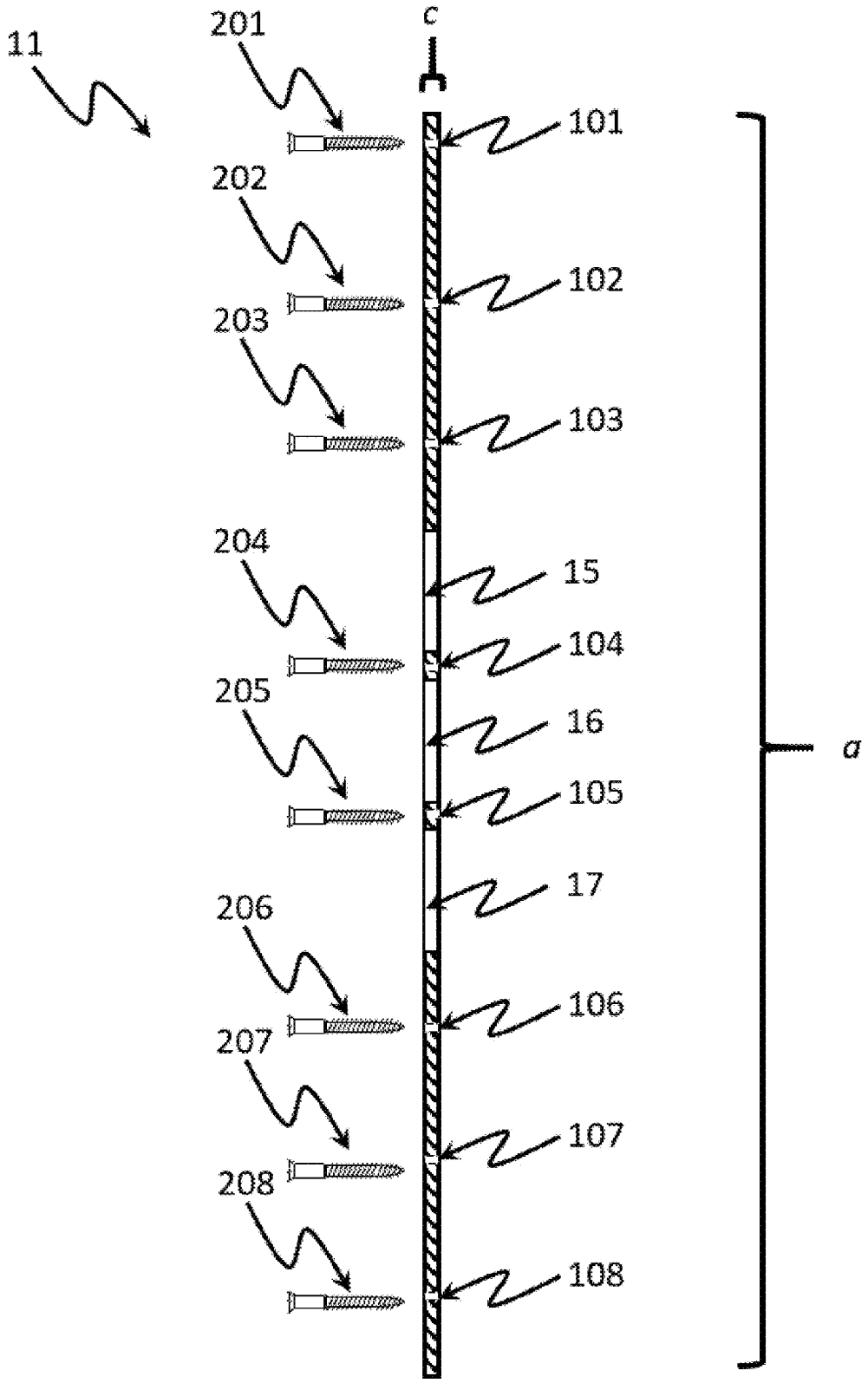

FIG. 1C shows a representative cross-sectional view of a door frame bar, 11, along a center-line axis of the door frame bar. The door frame bar is characterized by a thickness dimension, c, as shown in FIG. 1C. The thickness dimension, c, can be from about 1/32 of an inch to about ⅜ of an inch. The other indicia numbers shown in FIG. 1C have the same meaning as described herein.

Figure 1D:
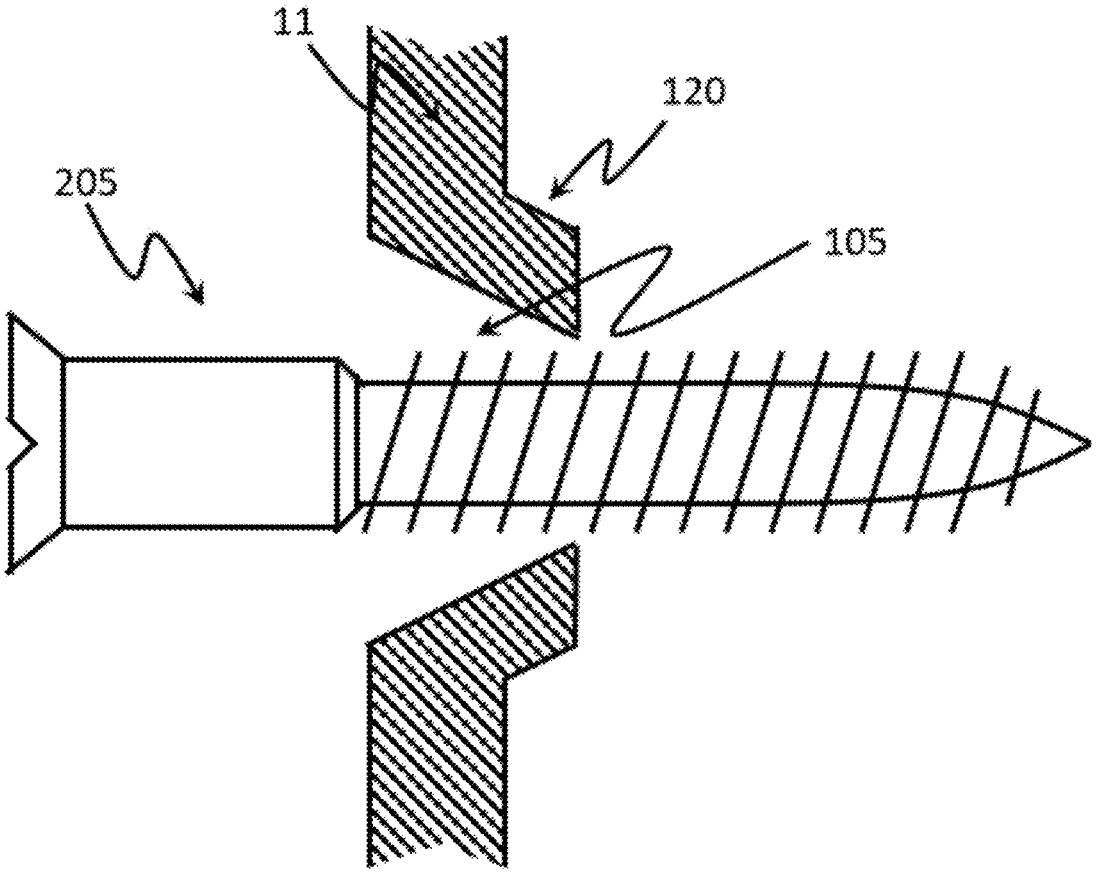

FIG. 1D shows a fragmentary cross-sectional view of a door frame bar, 11, showing a door frame screw opening, 105, that shows an angled or counter-sunk edge that can accept the screw head of door frame screw, 205. The door frame screw opening, 105, further comprises a door frame bar screw hole countersink flange, 120. The door frame bar screw hole countersink flange, 120, allows the door frame screw, 205, to be fully counter-sunk and the head thereof flush with a surface of the door frame. Moreover, the door frame bar screw hole countersink flange, 120, provides additional strength and rigidity in the area of the door frame screw hole, 105, of the door frame, 11. A door frame screw hole further comprising a door frame bar screw hole countersink flange can be utilized for any of the door frame screw holes, that is, the specific aspect shown in FIG. 1D should not be viewed as limited only to door frame screw hole, 105.

Figure 2:
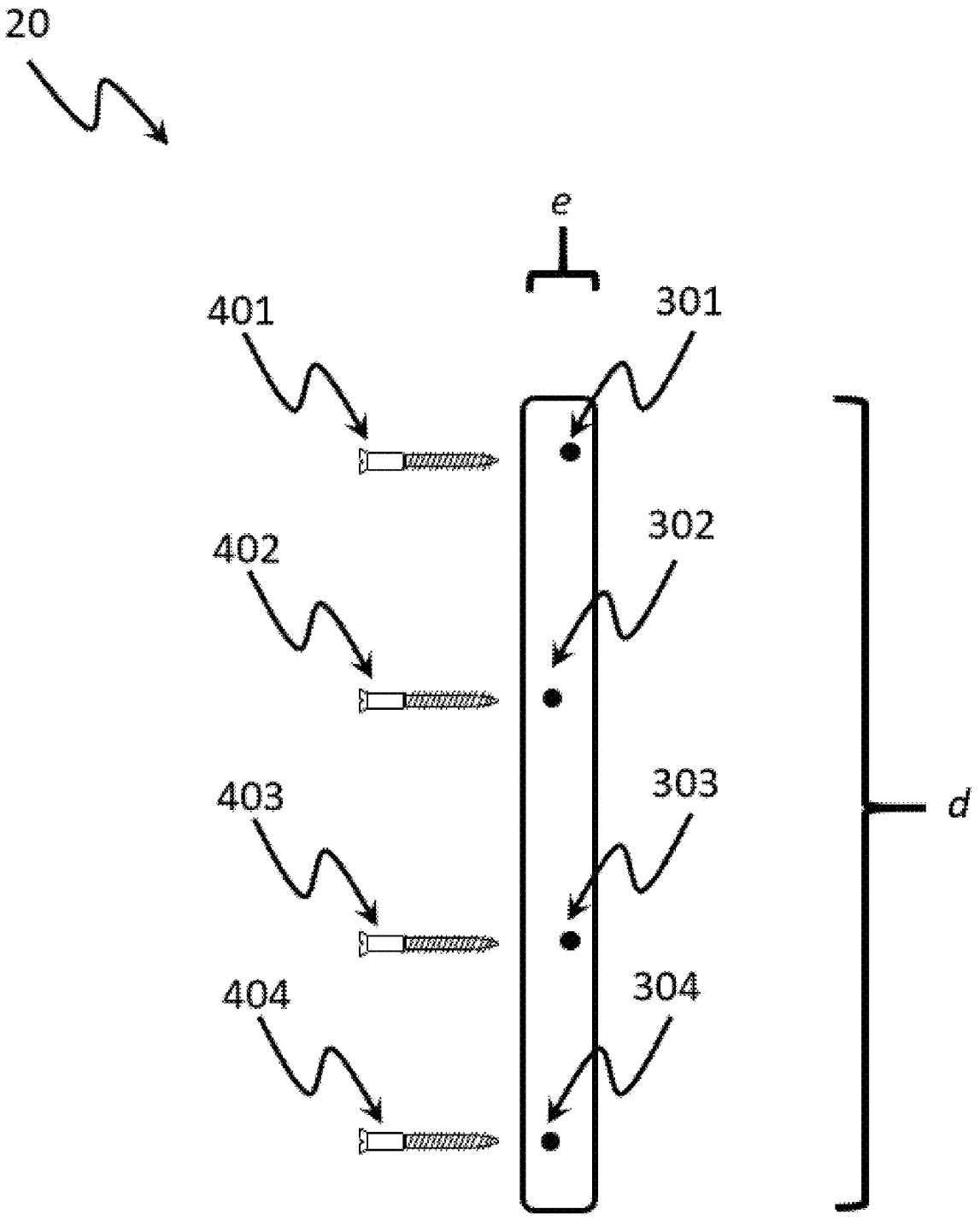
FIG. 2 shows a representative front view of a disclosed door hinge bar.

FIG. 2 shows a representative front view of a door hinge bar, 20. The door hinge bar, 20, can be fabricated, in various aspects, from steel, iron, aluminum, carbon-fiber materials, or a high-impact, high-tensile strength polymeric material. In a further aspect, the the door frame bar is fabricated from steel. The door hinge bar can have unfinished surfaces, or alternatively, may be fabricated with a finish such as a paint coating, an anodized finish, or a polymeric coating. The intended meaning of the length, d, and width, e, dimensions are as indicated in the figure. The length dimension, d, of the door hinge bar, 20, can be about 1.5 inches to about 18 inches. In an aspect, the length dimension, d, of the door hinge bar, 20, is about 6 inches to about 12 inches. In a further aspect, the length dimension, d, of the door hinge bar, 20, is about 8 inches to about 10 inches. In a still further aspect, the length dimension, d, of the door hinge bar, 20, is about 9 inches. The width dimension, e, of the door hinge bar, 20, can be about 0.25 to about 2 inches. In an aspect, the width dimension, e, of the door hinge bar, 20, is about 1.5 inches to about 2.5 inches. In a further aspect, the width dimension, e, of the door hinge bar, 20, is about 0.125 inches to about 1 inch. In a still further aspect, the width dimension, e, of the door hinge bar, 20, is about 0.5 inches to about 0.75 inches. In a yet further aspect, the width dimension, e, of the door hinge bar, 20, is about 0.75 inches. The door hinge bar is about 1/16 inch thick to about ½ inch thick.

The door hinge bar, 20, is secured using a fastener to an interior face of a door frame and positioned approximately centered in the vertical and horizontal axes of the interior face of the door frame. The door hinge bar comprises a plurality of door hinge holes, e.g., from 2 to 8 holes. In an aspect, as shown in FIG. 2, the door hinge bar comprises four door hinge screw holes, 301-304. The door hinge bar screw holes are of a diameter to accept insertion of a fastener through the door frame hole.

In various aspects, the door hinge bar, 20, further comprises a plurality of fasteners that can be inserted through the door hinge screw holes to secure the door hinge bar flush against an interior face of the door located near a hinge, and positioned such that an outer edge of the door hinge bar is flush with an outer edge of the interior face of the door and approximately centered in the length dimension on the interior face approximately perpendicular to a hinge. In an aspect, as shown in FIG. 2, the door hinge bar comprises four fasteners such as four door frame screws, 401-404. The door hinge bar screw can be any standard screw suitable for securing the door frame bar to an inner face of the door frame, such as a wood screw, sheet metal screw, or machine screw. The choice of screw type will depend upon the type of material from which the door is fabricated. In various aspects, the wood screw or machine screw has a #2 to a #20 screw diameter per standard ANSI convention. The screw length can be appropriate for the door frame material and dimensions. In various aspects, the screw length is about 0.25 inches to about 6 inches.

Figure 3A:
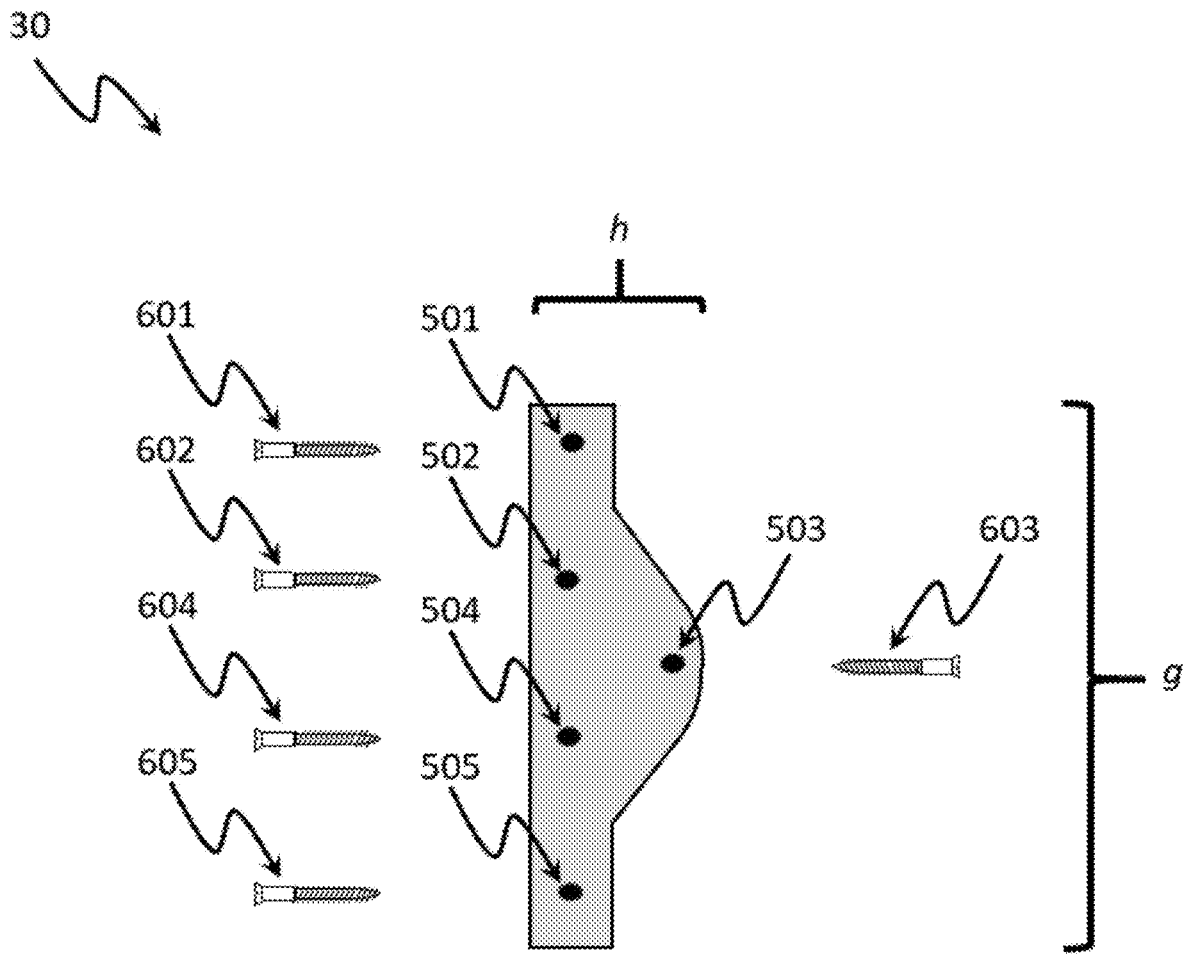
FIGS. 3A-3G show representative views of a disclosed door bracket.

FIG. 3A shows a representative front view of a door bracket, 30. The door bracket, 30, can be fabricated, in various aspects, from steel, iron, aluminum, carbon-fiber materials, or a high-impact, high-tensile strength polymeric material. In a further aspect, the the door bracket is fabricated from steel. The door bracket can have unfinished surfaces, or alternatively, may be fabricated with a finish such as a paint coating, an anodized finish, or a polymeric coating. The intended meaning of the length, g, and width, h, dimensions are as indicated in the figure. The width, h, dimension comprises the width, as shown, of the vertical member of the door bracket and the lateral protusion member. In an aspect, the length dimension, g, of the door bracket, 30, is about 6 inches to about 12 inches. In a further aspect, the length dimension, g, of the door bracket, 30, is about 8 inches to about 10 inches. In a still further aspect, the length dimension, g, of the door bracket, 30, is about 9 inches. The width dimension, h, of the door bracket, 30, can be about 0.25 to about 8 inches. In an aspect, the width dimension, h, of the door bracket, 30, is about 1.5 inches to about 6 inches. In a further aspect, the width dimension, h, of the door bracket, 30, is about 2 inches to about 4 inch. In a yet further aspect, the width dimension, h, of the door bracket, 30, is about 3 inches. The door bracket 30 has a thickness less than about ¼ inch.

Figure 3B:
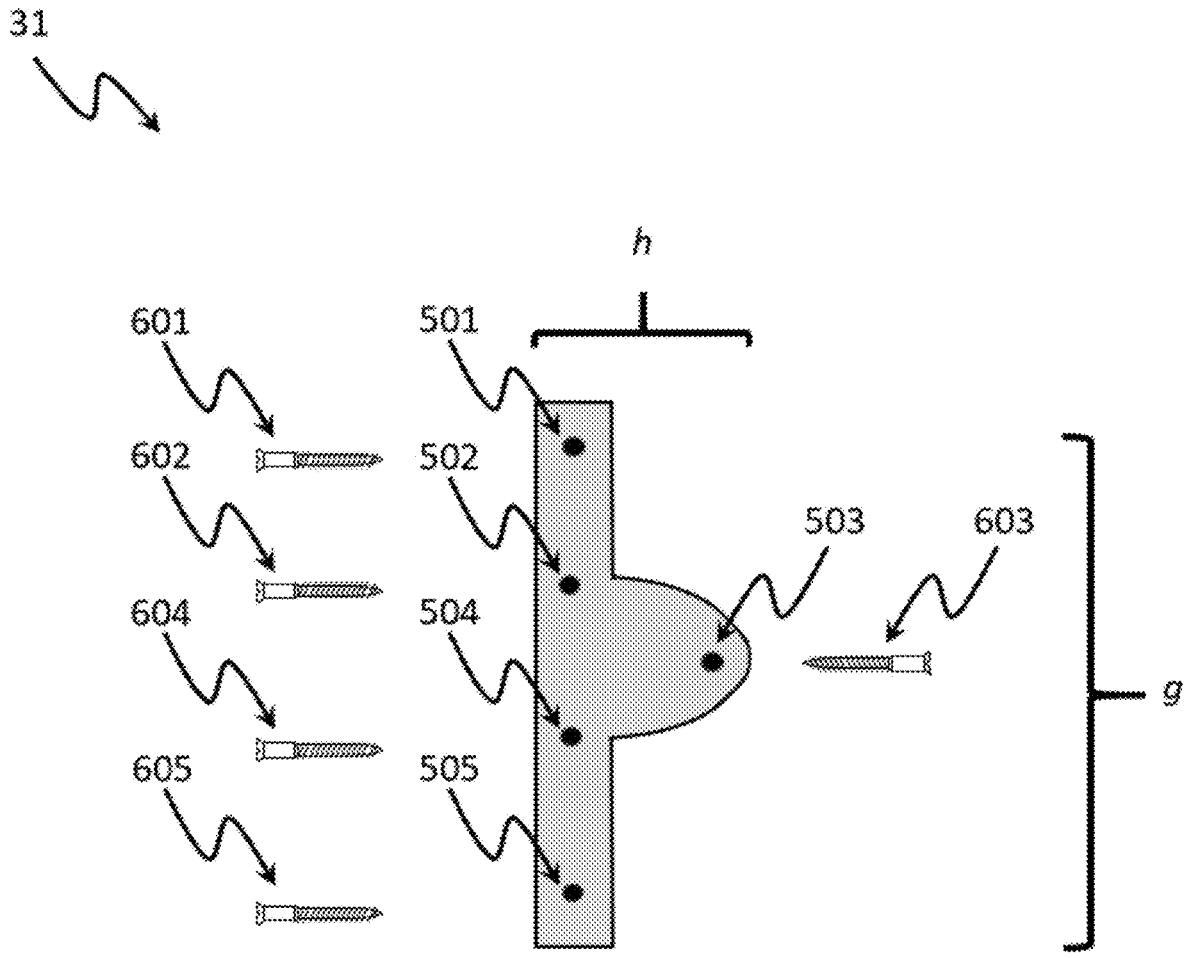
Figure 3C:
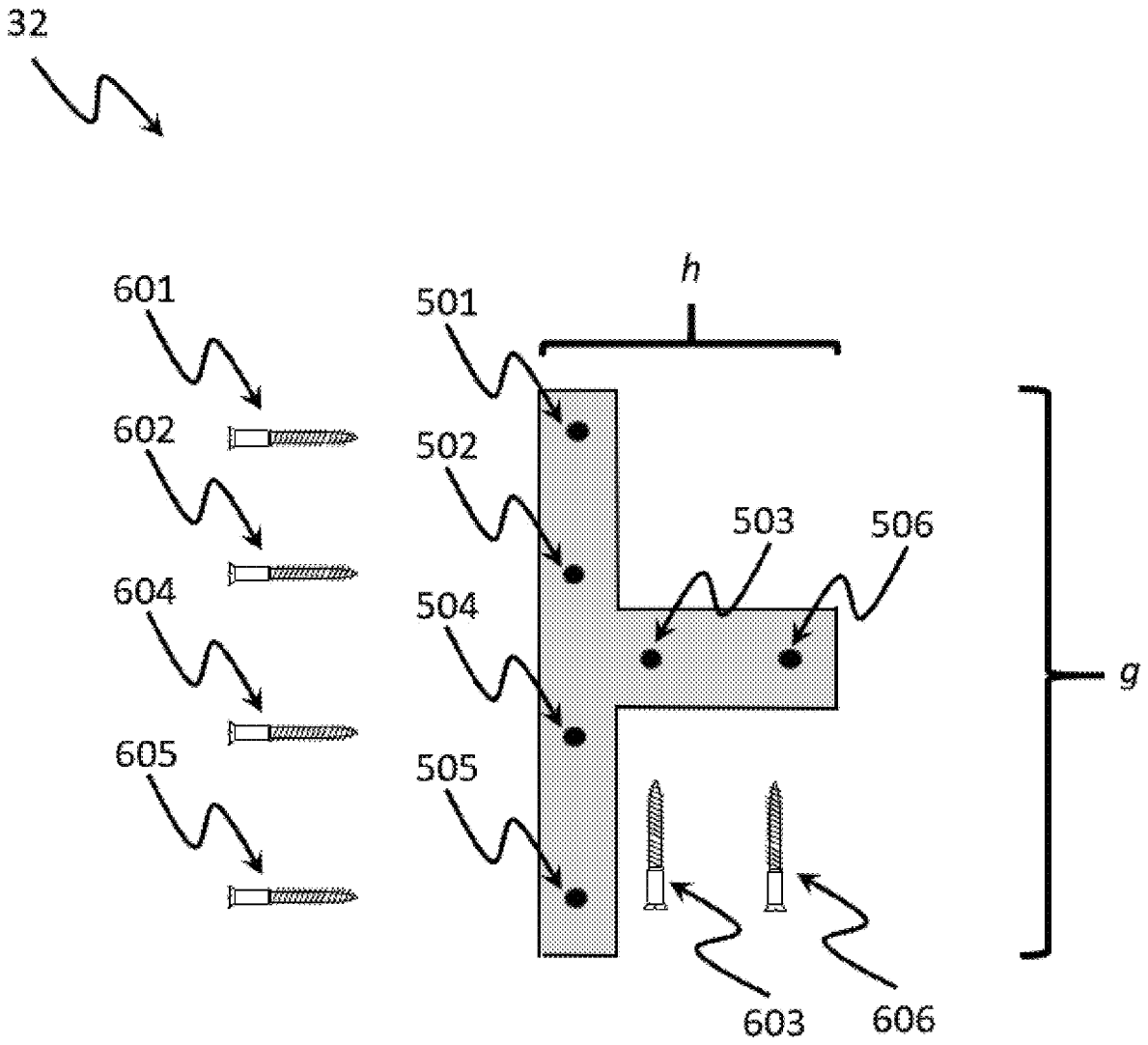
Figure 3D:
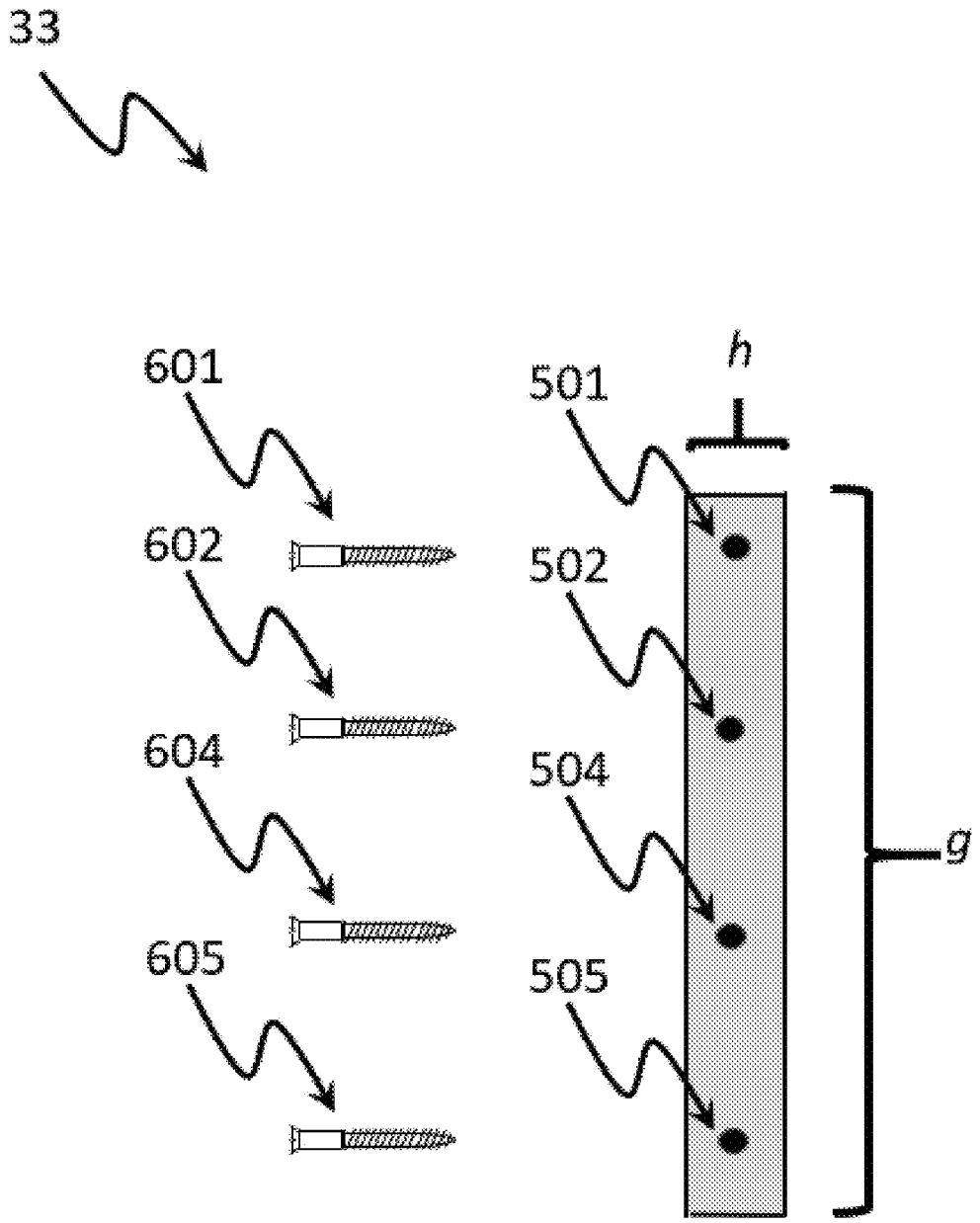

In some aspects, the door bracket comprises a vertical member with an optional lateral protusion. The lateral protusion can be of any useful geometry. For example, as shown in FIG. 3A, the lateral protusion has an ovoid shape oriented with the ovoid long axis in the length dimension of the door bracket, 30. Alternative geometries for the lateral protusion are shown for the door bracket, 31, as shown in FIG. 3B, and door bracket, 32, as shown in FIG. 3C. The optional lateral member is omitted in the door bracket, 33, as shown in FIG. 3D.

The door bracket, 30, is secured using a fastener to an interior face of a door bracket and positioned approximately centered with respect to a door handle assembly, a deadbolt assembly, or the overall center of both a door handle assembly and deadbolt assembly when both are present. The door bracket, 30, comprises a plurality of door bracket screw holes, e.g., from 2 to 8 holes. In an aspect, as shown in FIG. 3A, the door bracket comprises four door bracket screw holes, 501-502 and 504-505, located spaced approximately evenly along the length of the vertical portion of the door bracket, 30, and one door bracket screw holes, 502, located centered and near the outward edge of the lateral protusion of the door bracket, 30. The door bracket screw holes are of a diameter to accept insertion of a fastener through the door bracket screw hole.

In various aspects, the door bracket, 30, further comprises a plurality of fasteners that can be inserted through the door bracket screw holes to secure the door bracket flush against an interior face of the door positioned approximately centered with respect to a door handle assembly, a deadbolt assembly, or the overall center of both a door handle assembly and deadbolt assembly when both are present. In an aspect, as shown in FIG. 3A, the door bracket comprises five fasteners such as five door bracket screws, 601-605. The door bracket screw can be any standard screw suitable for securing the door bracket to flush to a face of the door, such as a wood screw, sheet metal screw, or machine screw. The choice of screw type will depend upon the type of material from which the door is fabricated. In various aspects, the wood screw or machine screw has a #2 to a #20 screw diameter per standard ANSI convention. The screw length can be appropriate for the door material and dimensions. In various aspects, the screw length is about 0.25 inches to about 1.5 inches.

FIG. 3B shows a representative front view of a door bracket, 31. The door bracket, 31, can be fabricated, in various aspects, from steel, iron, aluminum, carbon-fiber materials, or a high-impact, high-tensile strength polymeric material. In a further aspect, the the door bracket is fabricated from steel. The door bracket can have unfinished surfaces, or alternatively, may be fabricated with a finish such as a paint coating, an anodized finish, or a polymeric coating. The intended meaning of the length, g, and width, h, dimensions are as indicated in the figure. The width, h, dimension comprises the width, as shown, of the vertical member of the door bracket and the lateral protusion member. In an aspect, the length dimension, g, of the door bracket, 31, is about 6 inches to about 12 inches. In a further aspect, the length dimension, g, of the door bracket, 31, is about 8 inches to about 10 inches. In a still further aspect, the length dimension, g, of the door bracket, 30, is about 9 inches. The width dimension, h, of the door bracket, 31, can be about 0.25 to about 8 inches. In an aspect, the width dimension, h, of the door bracket, 31, is about 1.5 inches to about 6 inches. In a further aspect, the width dimension, h, of the door bracket, 31, is about 2 inches to about 4 inch. In a yet further aspect, the width dimension, h, of the door bracket, 31, is about 3 inches. The door bracket 31 has a thickness less than about ¼ inch.

In some aspects, the door bracket comprises a vertical member with an optional lateral protusion. The lateral protusion can be of any useful geometry. For example, as shown in FIG. 3B, the lateral protusion has an ovoid shape oriented with the ovoid long axis perpendicular to the length dimension of the door bracket, 31.

The door bracket, 31, is secured using a fastener to an interior face of a door bracket and positioned approximately centered with respect to a door handle assembly, a deadbolt assembly, or the overall center of both a door handle assembly and deadbolt assembly when both are present. The door bracket, 31, comprises a plurality of door bracket screw holes, e.g., from 2 to 8 holes. In an aspect, as shown in FIG. 3B, the door bracket comprises four door bracket screw holes, 501-502 and 504-505, located spaced approximately evenly along the length of the vertical portion of the door bracket, 31, and one door bracket screw holes, 502, located centered and near the outward edge of the lateral protusion of the door bracket, 31. The door bracket screw holes are of a diameter to accept insertion of a fastener through the door bracket screw hole.

In various aspects, the door bracket, 31, further comprises a plurality of fasteners that can be inserted through the door bracket screw holes to secure the door bracket flush against an interior face of the door positioned approximately centered with respect to a door handle assembly, a deadbolt assembly, or the overall center of both a door handle assembly and deadbolt assembly when both are present. In an aspect, as shown in FIG. 3B, the door bracket comprises five fasteners such as five door bracket screws, 601-605. The door bracket screw can be any standard screw suitable for securing the door bracket to flush to a face of the door, such as a wood screw, sheet metal screw, or machine screw. The choice of screw type will depend upon the type of material from which the door is fabricated. In various aspects, the wood screw or machine screw has a #2 to a #20 screw diameter per standard ANSI convention. The screw length can be appropriate for the door material and dimensions. In various aspects, the screw length is about 0.25 inches to about 1.5 inches.

FIG. 3C shows a representative front view of a door bracket, 32. The door bracket, 32, can be fabricated, in various aspects, from steel, iron, aluminum, carbon-fiber materials, or a high-impact, high-tensile strength polymeric material. In a further aspect, the the door bracket is fabricated from steel. The door bracket can have unfinished surfaces, or alternatively, may be fabricated with a finish such as a paint coating, an anodized finish, or a polymeric coating. The intended meaning of the length, g, and width, h, dimensions are as indicated in the figure. The width, h, dimension comprises the width, as shown, of the vertical member of the door bracket and the lateral protusion member. In an aspect, the length dimension, g, of the door bracket, 32, is about 6 inches to about 12 inches. In a further aspect, the length dimension, g, of the door bracket, 32, is about 8 inches to about 10 inches. In a still further aspect, the length dimension, g, of the door bracket, 32, is about 9 inches. The width dimension, h, of the door bracket, 32, can be about 0.25 to about 8 inches. In an aspect, the width dimension, h, of the door bracket, 32, is about 1.5 inches to about 6 inches. In a further aspect, the width dimension, h, of the door bracket, 32, is about 2 inches to about 4 inch. In a yet further aspect, the width dimension, h, of the door bracket, 32, is about 3 inches.

In some aspects, the door bracket comprises a vertical member with an optional lateral protusion. The lateral protusion can be of any useful geometry. For example, as shown in FIG. 3C, the lateral protusion has rectangular shape oriented with the rectangular long axis perpendicular to the length dimension of the door bracket, 32.

The door bracket, 32, is secured using a fastener to an interior face of a door bracket and positioned approximately centered with respect to a door handle assembly, a deadbolt assembly, or the overall center of both a door handle assembly and deadbolt assembly when both are present. The door bracket, 32, comprises a plurality of door bracket screw holes, e.g., from 2 to 8 holes. In an aspect, as shown in FIG. 3C, the door bracket comprises four door bracket screw holes, 501-502 and 504-505, located spaced approximately evenly along the length of the vertical portion of the door bracket, 30, and two door bracket screw holes, 502 and 506, located centered in the length dimension and evenly spaced along the long axis of the lateral protusion of the door bracket, 32. The door bracket screw holes are of a diameter to accept insertion of a fastener through the door bracket screw hole.

In various aspects, the door bracket, 32, further comprises a plurality of fasteners that can be inserted through the door bracket screw holes to secure the door bracket flush against an interior face of the door positioned approximately centered with respect to a door handle assembly, a deadbolt assembly, or the overall center of both a door handle assembly and deadbolt assembly when both are present. In an aspect, as shown in FIG. 3C, the door bracket comprises five fasteners such as five door bracket screws, 601-605. The door bracket screw can be any standard screw suitable for securing the door bracket to flush to a face of the door, such as a wood screw, sheet metal screw, or machine screw. The choice of screw type will depend upon the type of material from which the door is fabricated. In various aspects, the wood screw or machine screw has a #2 to a #20 screw diameter per standard ANSI convention. The screw length can be appropriate for the door material and dimensions. In various aspects, the screw length is about 0.25 inches to about 1.5 inches.

FIG. 3D shows a representative front view of a door bracket, 33. The door bracket, 33, can be fabricated, in various aspects, from steel, iron, aluminum, carbon-fiber materials, or a high-impact, high-tensile strength polymeric material. In a further aspect, the the door bracket is fabricated from steel. The door bracket can have unfinished surfaces, or alternatively, may be fabricated with a finish such as a paint coating, an anodized finish, or a polymeric coating. The intended meaning of the length, g, and width, h, dimensions are as indicated in the figure. The width, h, dimension comprises the width, as shown, of the vertical member of the door bracket and the lateral protusion member. In an aspect, the length dimension, g, of the door bracket, 33, is about 0.5 inches to about 3 inches. In a further aspect, the length dimension, g, of the door bracket, 33, is about 8 inches to about 10 inches. In a still further aspect, the length dimension, g, of the door bracket, 33, is about 9 inches. The width dimension, h, of the door bracket, 33, can be about 0.5 to about 2.5 inches. In an aspect, the width dimension, h, of the door bracket, 33, is about 1.5 inches to about 2 inches. In a further aspect, the width dimension, h, of the door bracket, 33, is about 2 inches.

In some aspects, the door bracket comprises a vertical member without an optional lateral protusion member. For example, as shown in FIG. 3D, the lateral protusion member is absent, and the door bracket is characterized with a rectangular shape oriented with the long dimension vertical to the orientation of the door.

The door bracket, 33, is secured using a fastener to an interior face of a door bracket and positioned approximately centered with respect to a door handle assembly, a deadbolt assembly, or the overall center of both a door handle assembly and deadbolt assembly when both are present. The door bracket, 33, comprises a plurality of door bracket screw holes, e.g., from 2 to 8 holes. In an aspect, as shown in FIG. 3A, the door bracket comprises four door bracket screw holes, 501-502 and 504-505, located spaced approximately evenly along the length of the vertical portion of the door bracket, 30. The door bracket screw holes are of a diameter to accept insertion of a fastener through the door bracket screw hole.

In various aspects, the door bracket, 33, further comprises a plurality of fasteners that can be inserted through the door bracket screw holes to secure the door bracket flush against an interior face of the door positioned approximately centered with respect to a door handle assembly, a deadbolt assembly, or the overall center of both a door handle assembly and deadbolt assembly when both are present. In an aspect, as shown in FIG. 3A, the door bracket comprises five fasteners such as five door bracket screws, 601-602 and 604-605. The door bracket screw can be any standard screw suitable for securing the door bracket to flush to a face of the door, such as a wood screw, sheet metal screw, or machine screw. The choice of screw type will depend upon the type of material from which the door is fabricated. In various aspects, the wood screw or machine screw has a #2 to a #20 screw diameter per standard ANSI convention. The screw length can be appropriate for the door material and dimensions. In various aspects, the screw length is about 0.25 inches to about 1.5 inches.

The vertical member and lateral protusion member of the door bracket can be a single continuous piece. The single continuous piece of a door bracket can be fabricated by metal stamping or maching methods, if the door bracket is fabricated from a metal; molding methods, such as injection molding, if the door bracket is fabricated from a high impact, high tensile strength polymer; or casting methods. Alternatively, the vertical member and lateral protusion member can be separate pieces that have been joined together by welding, adhesive, or other joining techniques suitable for the material from which the door bracket is fabricated.

Figure 3E:
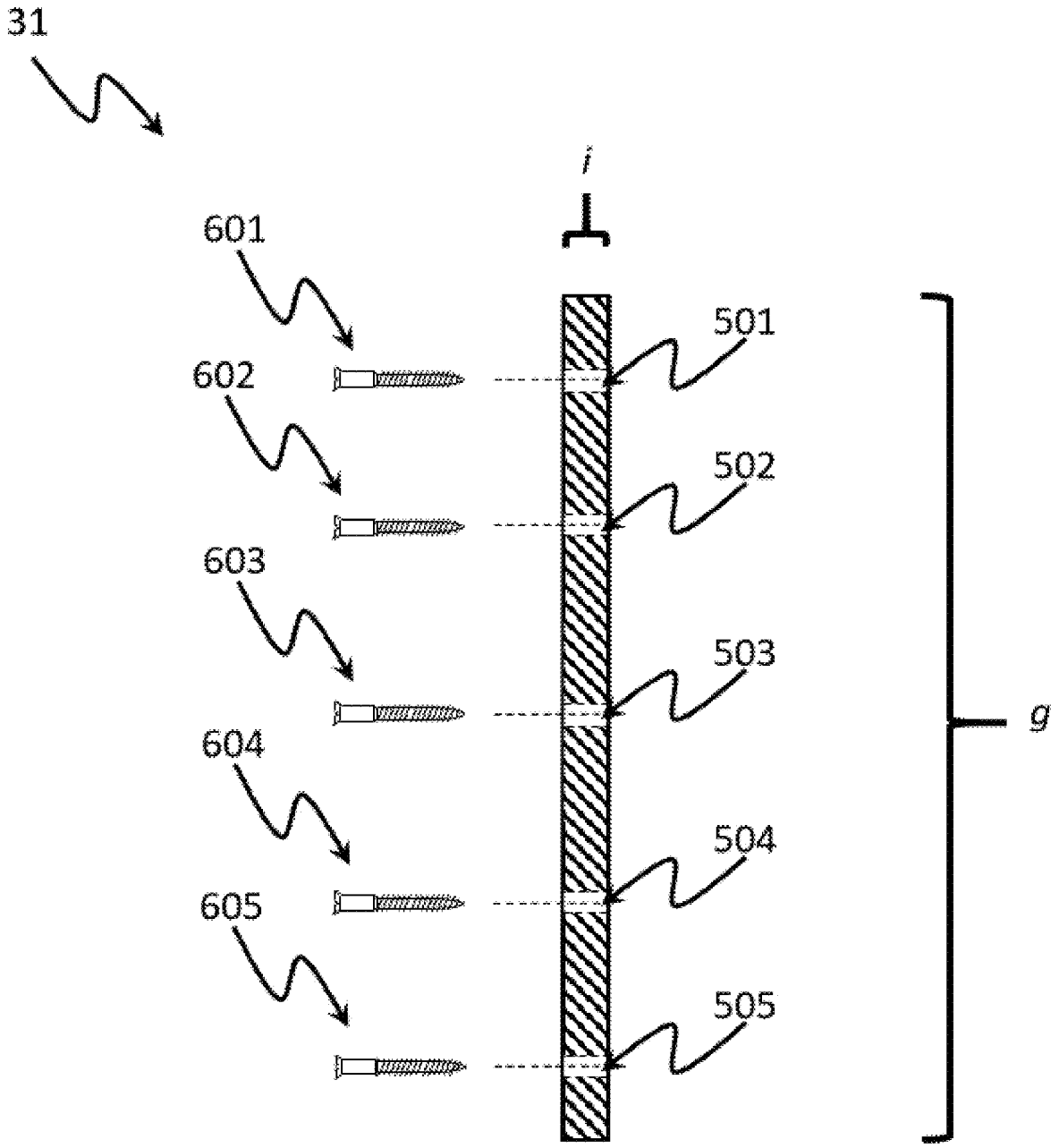

FIG. 3E shows a representative cross-sectional view of a door bracket, 31. The door bracket is characterized by a thickness dimension, i, as shown in FIG. 3E. The thickness dimension, i, can be from about 1/32 of an inch to about 3/8 of an inch. The other indicia numbers shown in FIG. 3E have the same meaning as described herein.

Figure 3F:
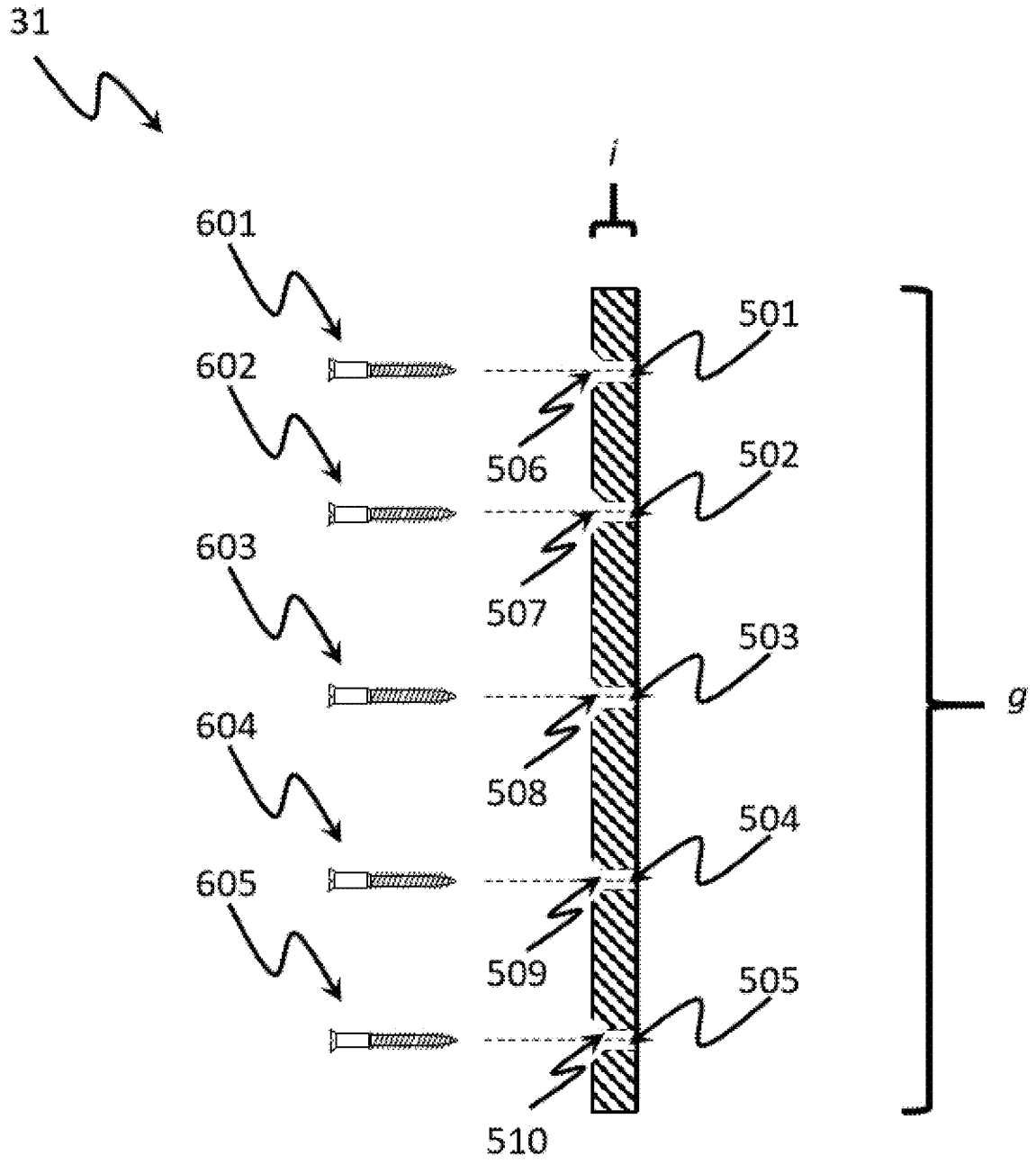

FIG. 3F shows a representative cross-sectional view of a door bracket, 31. The door bracket is characterized by a thickness dimension, i, as shown in FIG. 3E. The thickness dimension, i, can be from about 1/32 of an inch to about 3/8 of an inch. The other indicia numbers shown in FIG. 3E have the same meaning as described herein. The cross-sectional view in FIG. 3F shows that the door bracket screw holes further comprise counter-sink openings, 506-510.

Figure 3G:
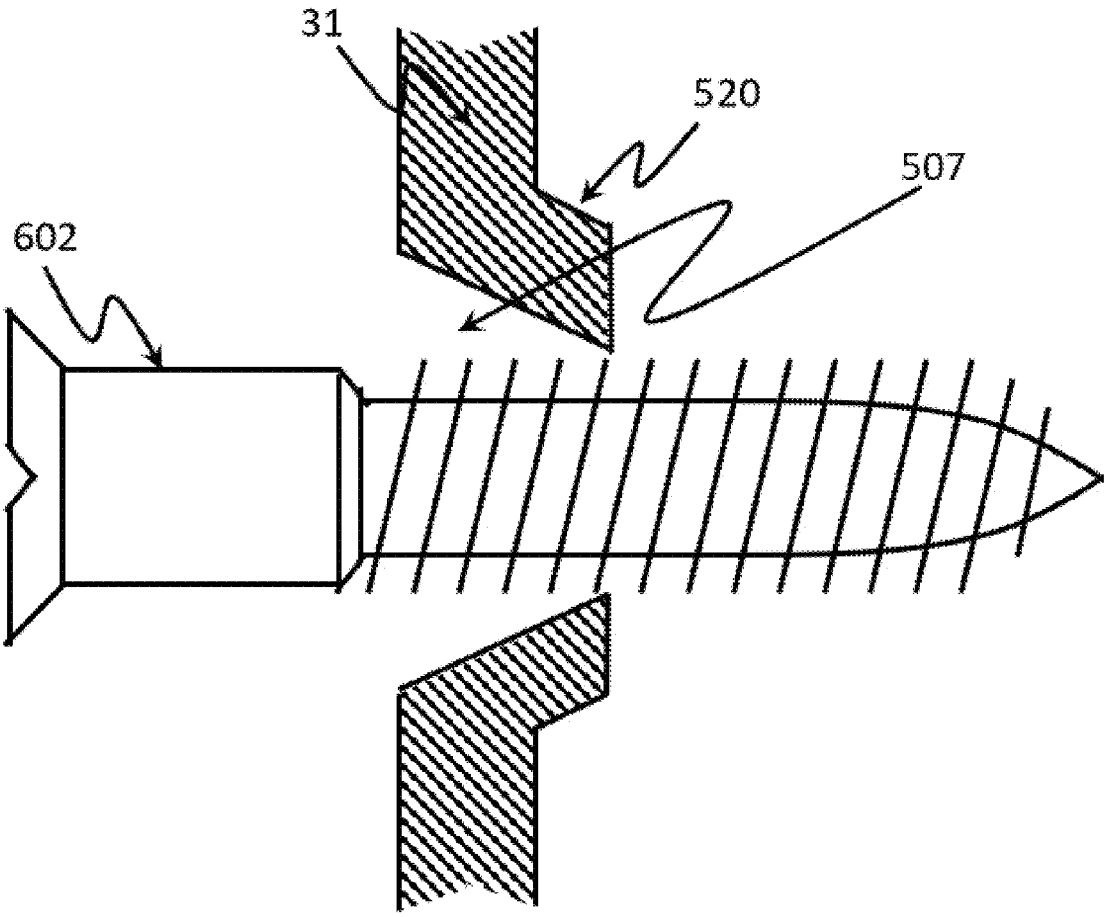

FIG. 3G shows a fragmentary cross-sectional view of a door bracket, 31, showing a door frame screw opening, 507, that shows an angled or counter-sunk edge that can accept the screw head of door bracket screw, 602. The door bracket screw opening, 507, further comprises a door bracket screw hole countersink flange, 520. The door bracket screw hole countersink flange, 520, allows the door bracket screw, 602, to be fully counter-sunk and the head thereof flush with a surface of the door. Moreover, the door bracket screw hole countersink flange, 520, provides additional strength and rigidity in the area of the door bracket screw hole, 507, of the door bracket, 31. A door bracket screw hole further comprising a door bracket screw hole countersink flange can be utilized for any of the door bracket screw holes, that is, the specific aspect shown in FIG. 3G should not be viewed as limited only to door bracket screw hole, 507.

The disclosed door security apparatus comprises two door brackets, one to be installed on the interior face of the door and the other of exterior face of the door. In various aspects, the two door brackets mirror one another in overall shape, dimensions, and geometry.

Figure 4:
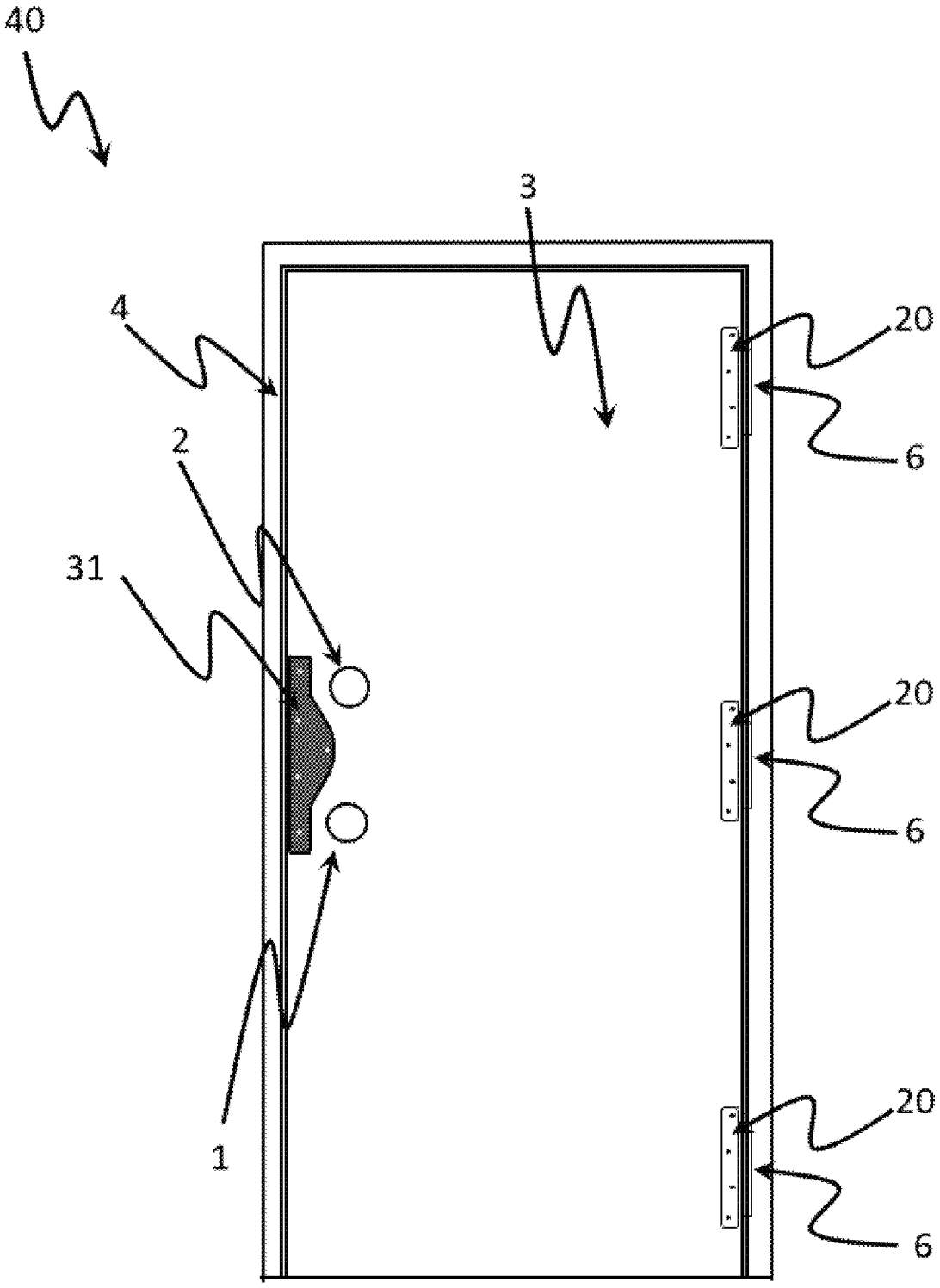
FIG. 4 shows a representative front view of an interior surface of a door showing placement of a door bracket and door hinge bars.

FIG. 4 shows installation of a door security apparatus, 40, on an interior face of a door, 3, and door frame, 4, with components of a representative disclosed door security apparatus shown installed thereon. The door comprises a door handle assembly and door deadbolt assembly, 1 and 2, respectively; and three door hinges, 6. As shown in the figure, a door bracket, 31, is shown installed with one edge thereof flush with an outside edge of the door, 3, positioned approximately centered in the vertical axis relative to a vertical axis oriented from the door handle assemble to the door deadbolt assembly. The rear face of the door bracket, 31, is mounted flush with the face of the door as shown therein. The figure shows three door hinge bars installed on the door face and each positioned such that an outward edge of a door hinge bar is flush with the edge of the door, 3, opposing the hinge, 6. In the vertical axis, a door hinge bar, 20, is centered relative to the vertical axis of a door hinge, 6.

Figure 5A:
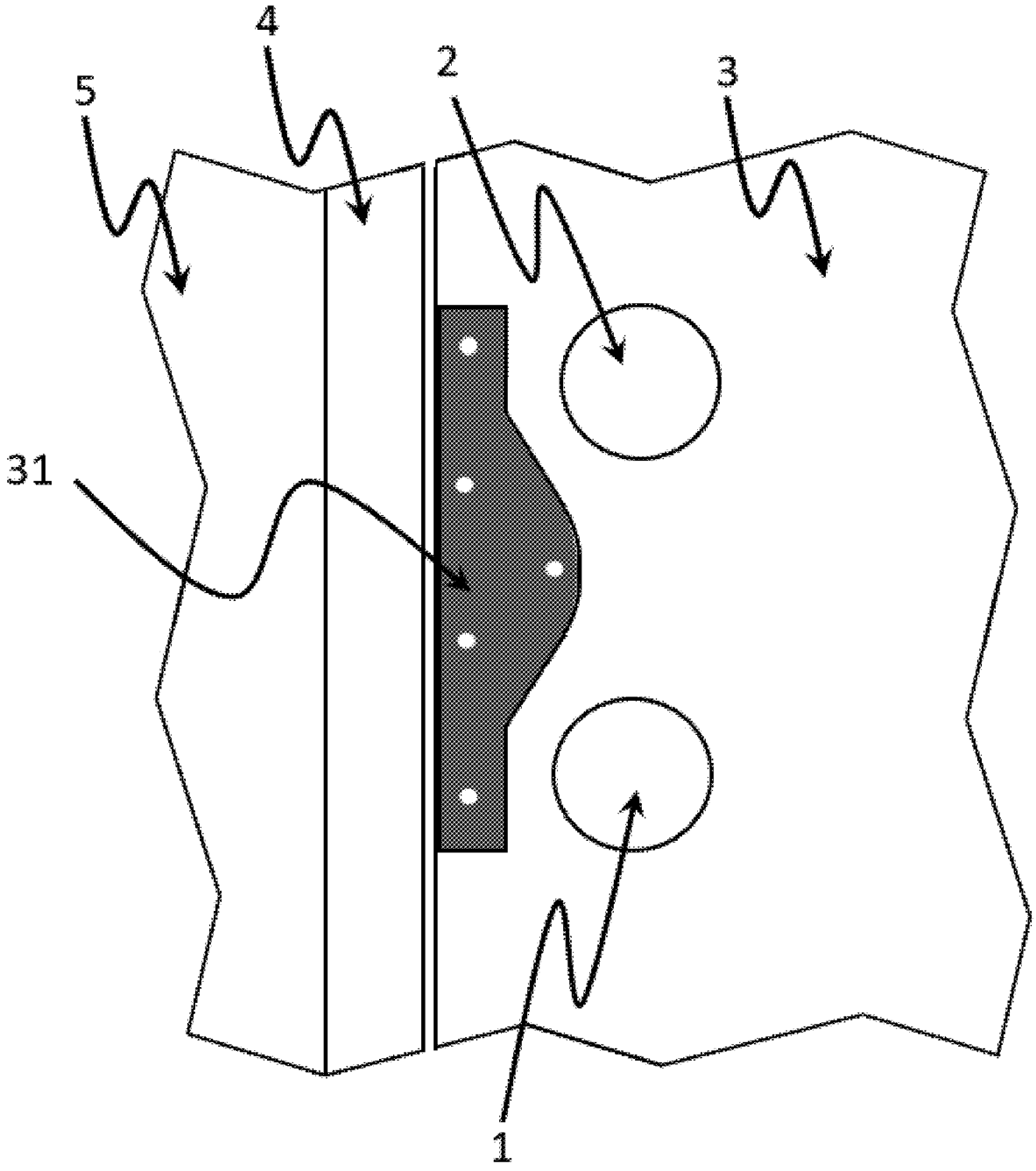
FIGS. 5A-5B show representative fragmentary front views of a door bracket.

FIG. 5A shows a fragmentary front view of an installed door bracket, 31, showing relative orientation and placement of the door bracket to the door handle assembly, 1, and door deadbolt assembly, 2.

Figure 5B:
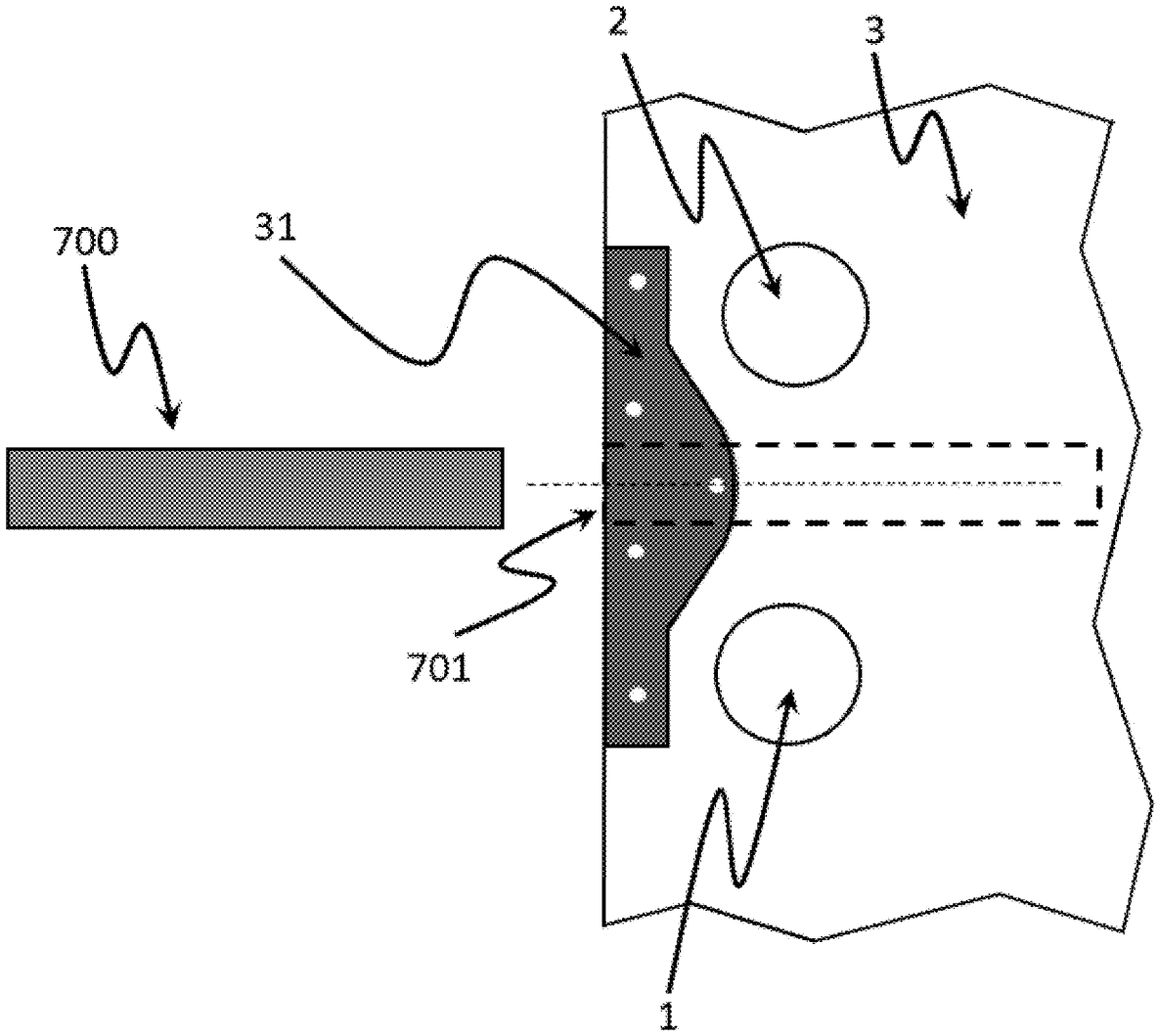

FIG. 5B shows a fragmentary front view of an installed door bracket, 31, showing relative orientation and placement of the door bracket to the door handle assembly, 1, and door deadbolt assembly, 2, and further comprising a reinforcing bar, 700, that is placed within a reinforcing bar opening, 701. The reinforcing bar, 700, can be fabricated, in various aspects, from steel, iron, aluminum, carbon-fiber materials, or a high-impact, high-tensile strength polymeric material. In a further aspect, the the door bracket is fabricated from steel. The reinforcing bar can have unfinished surfaces, or alternatively, may be fabricated with a finish such as a paint coating, an anodized finish, or a polymeric coating. The reinforcing bar, 700, can have a circular, ovoid, rectangular, or square cross-sectional geometry. The reinforcing bar opening, 701, has a cross-sectional geometry that is complementary to the cross-sectional geometry of the reinforcing bar, 700. The overall cross-sectional width of the reinforcing bar opening, 701, is the same, slightly larger (1/128" to 1/16" larger), or slightly smaller (1/128" to 1/16" larger) than the cross-sectional width of the reinforcing bar, 700. The reinforcing bar, 700, can be stably held within the reinforcing bar opening, 701, by friction between the reinforcing bar, 700, and reinforcing bar opening, 701. Alternatively, the reinforcing bar, 700, can be inserted into the reinforcing bar opening, 701, after a suitable amount of adhesive, e.g., an epoxy adhesive, has been provided into the reinforcing bar opening, 701.

Figure 6A:
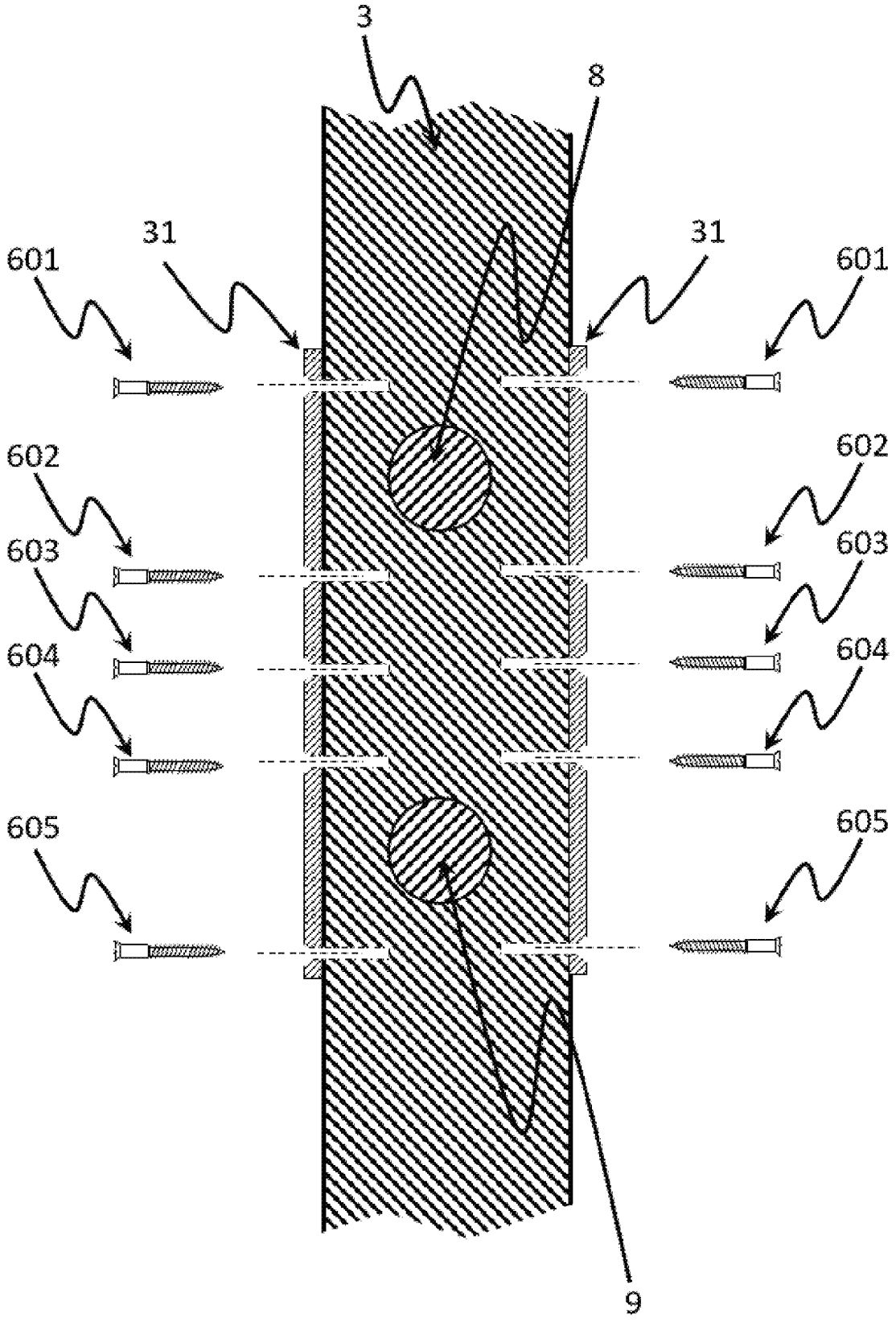
FIGS. 6A-6B show representative fragmentary cross-sectional views of a door edge.

FIG. 6A shows a fragmentary cross-sectional view of a door, 3, outside edge with the bolt, 8, of a door deadbolt assembly and deadlatch, 9, of a door handle assembly shown. The figure shows a first door bracket, 31, and a second door bracket, 31, installed flush to the respective faces of the door on which they are installed.

Figure 6B:
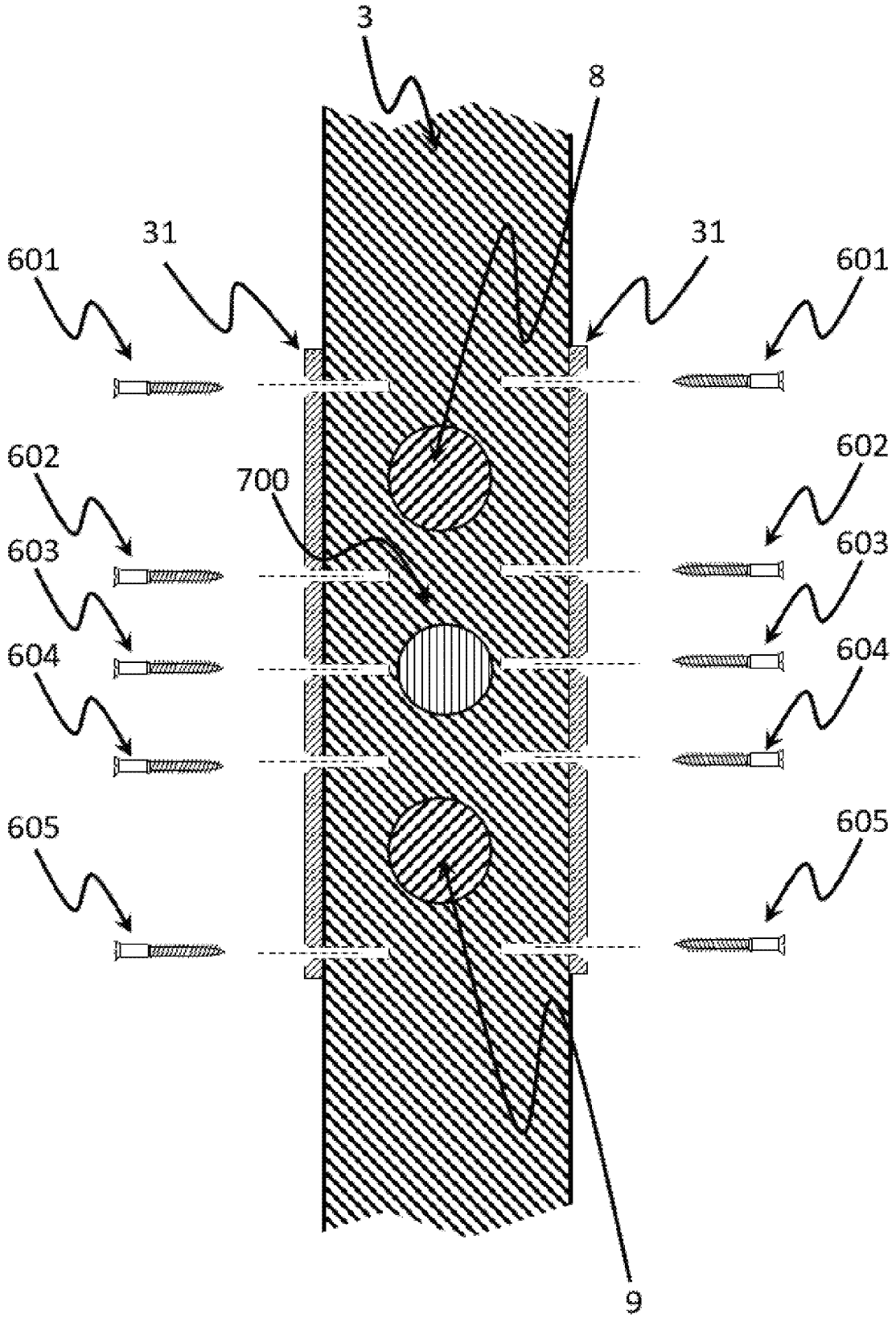

FIG. 6B shows a fragmentary cross-sectional view of a door, 3, outside edge with the bolt, 8, of a door deadbolt assembly and deadlatch, 9, of a door handle assembly shown, further comprising a reinforcing bar, 700. The figure shows a first door bracket, 31, and a second door bracket, 31, installed flush to the respective faces of the door on which they are installed.

Figure 7:
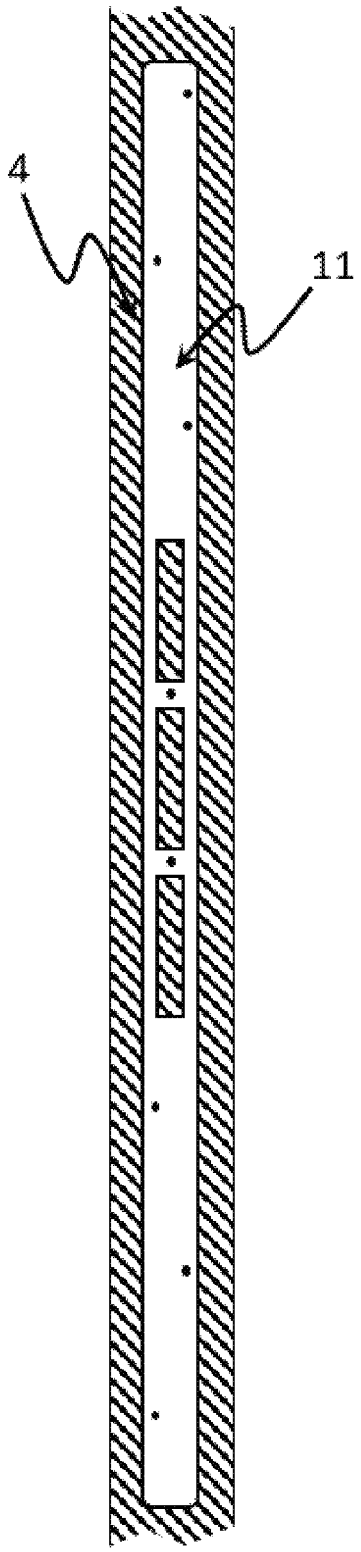
FIG. 7 shows a representative fragmentary cross-sectional view of a door frame with placement of a disclosed door frame bar thereon.

FIG. 7 shows a fragmentary front view of a door frame bar, 11, mounted flush against a door frame, 4, portion that is located opposing a door edge comprising a door handle assembly and door deadbolt assembly.

Figure 8:
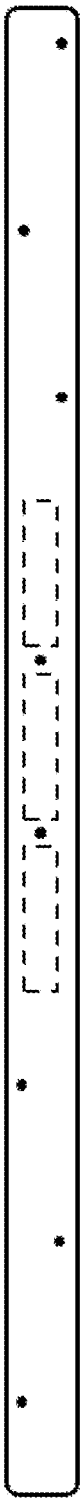
FIG. 8 shows an image of a representative disclosed door frame bar.
Figure 9:
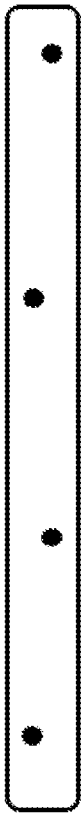
FIG. 9 shows an image of a representative disclosed door hinge bar.
Figure 10:
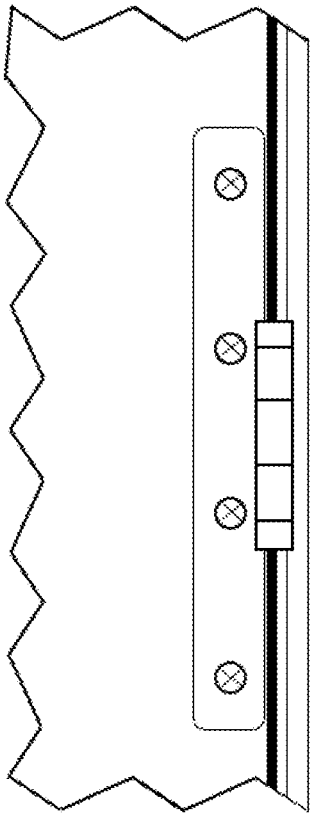
FIG. 10 shows an image of a representative disclosed door hinge bar installed on a door showing the placement relative to a door hinge.
Figure 11:
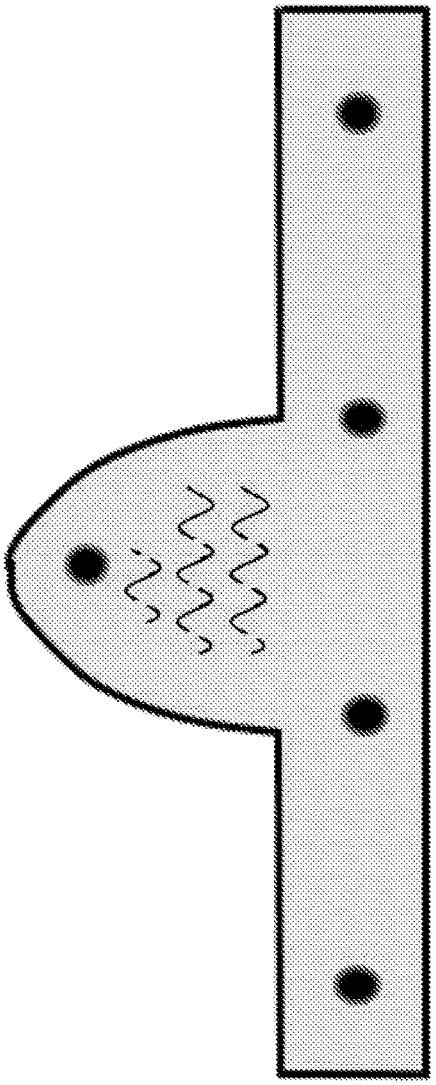
FIG. 11 shows an image of a representative disclosed bracket from a front view. The door bracket shows a decorative design cut-out in the door bracket.
Figure 12:
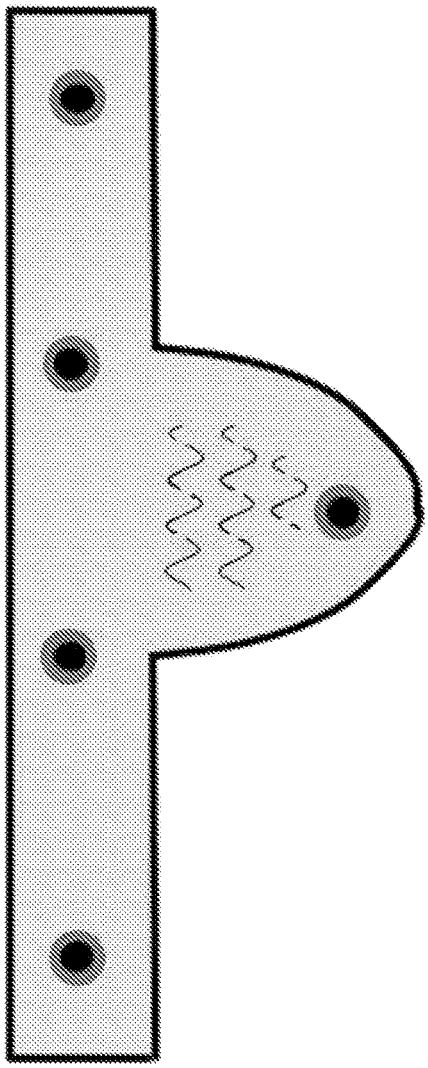
FIG. 12 shows an image of a representative disclosed bracket shown in FIG. 11 from the opposite side, showing the surface of the door bracket that is in contact with a surface of the door. The image shows counter-sink flanges extending from the back surface of the door bracket.
Figure 13:
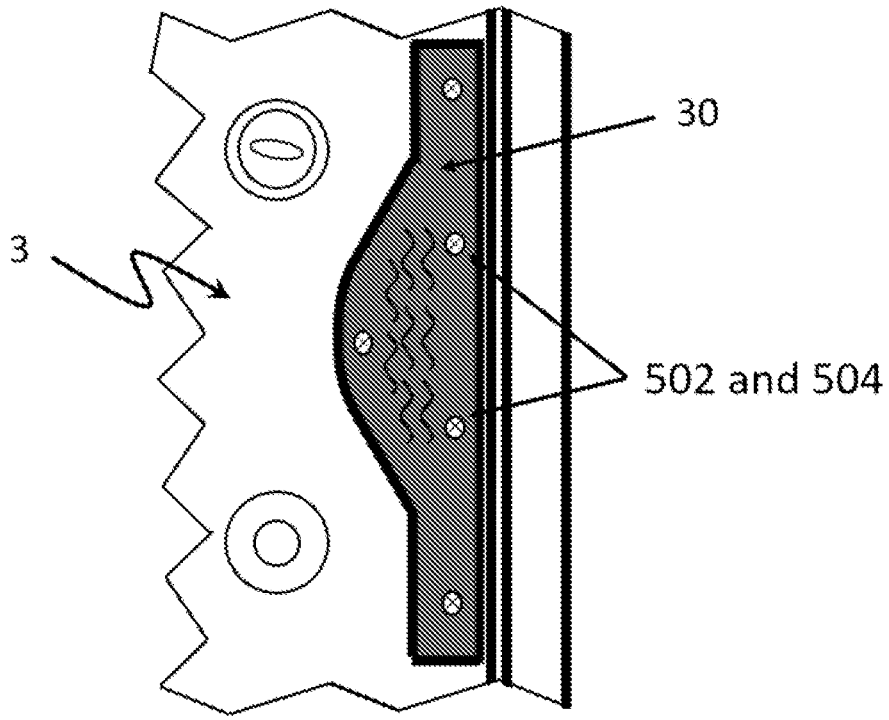
FIG. 13 shows an image of a representative perspective front view of a portion of a mid-section of an interior surface of a door showing the position of the a door bracket, 30, installed on an interior surface of a door, 3, completely installed on the door with screws, e.g., 502 and 504, completely inserted through the door bracket, 30, and into the door.
Figure 14:
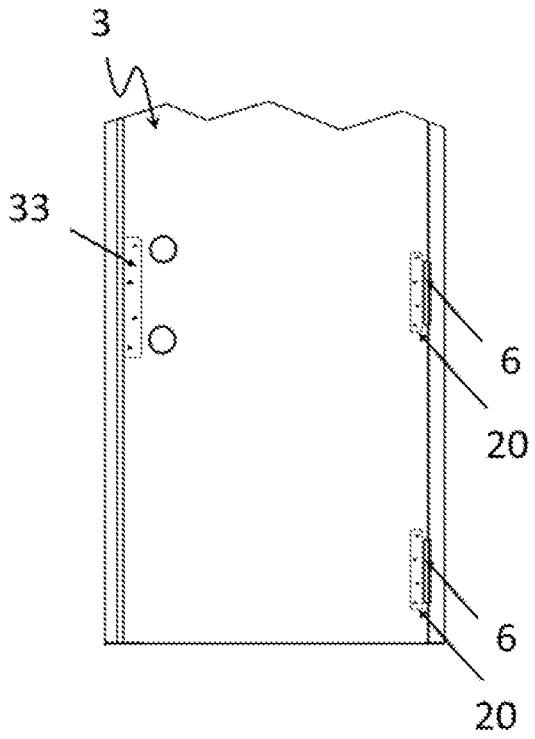
FIG. 14 shows an image of a representative perspective front view of a portion of an interior surface of a door, 3, showing the position of a door bracket, 33, and door hinge bars, 20, relative to door hinges, 6.

In various aspects, representative exemplary components of the present disclosure are shown in images disclosed herein, such as a door frame bar (see FIG. 8), a door hinge bar (see FIG. 9), and a door bracket (see FIGS. 11 and 12, showing the inward face of the door bracket and the rear face of the door bracket that is flush contact with the door, 3, when installed on a door). In a further aspect of the present disclosure, portions of an exemplary installed disclosed apparatus comprising an exemplary installed door bracket, 30, is shown on the interior face of a door, 3, showing the placement relative to the interior door knob and interior doorbolt escutcheon (see FIG. 13). The image specifically shows two of the door bracket screw holes, 502 and 504, with screws therein securing the door bracket to the door, 3. In a still further aspect of the present disclosure, portions of an exemplary installed disclosed apparatus comprising an exemplary installed door bracket, 33, and exemplary installed door hinge bars are shown on the interior face of a door, 3, near door hinges, 6.

It is to be understood that this disclosure is not limited to particular aspects described, and as such may, of course, vary. Other systems, methods, features, and advantages of foam compositions and components thereof will be or become apparent to one with skill in the art upon examination of the following drawings and detailed description. It is intended that all such additional systems, methods, features, and advantages be included within this description, be within the scope of the present disclosure, and be protected by the accompanying claims. It is also to be understood that the terminology used herein is for the purpose of describing particular aspects only, and is not intended to be limiting. The skilled artisan will recognize many variants and adaptations of the aspects described herein. These variants and adaptations are intended to be included in the teachings of this disclosure and to be encompassed by the claims herein.

It will be apparent to those skilled in the art that various modifications and variations can be made in the present disclosure without departing from the scope or spirit of the disclosure. Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. An apparatus comprising:

at least one door hinge bar comprising a plurality of holes therein for receiving a plurality of fasteners, wherein the at least one door hinge bar is secured flush against an interior surface of a door near at least one door hinge of the door;

wherein the at least one door hinge bar has an outward edge flush with an outside edge of the door near the at least one door hinge; and wherein the at least one door hinge bar is vertically centered relative to the at least one door hinge;

a first door bracket comprising a plurality of holes therein for receiving a plurality of fasteners, wherein the first door bracket is secured flush against to the interior surface of the door and positioned near a door handle assembly of the door, a deadbolt assembly of the door, or both the door handle assembly and the deadbolt assembly;

wherein an edge of the first door bracket is flush with an outside edge of the door near the door handle assembly, the deadbolt assembly, or both the door handle assembly and the deadbolt assembly;

a second door bracket comprising a plurality of holes therein for receiving a plurality of fasteners, wherein the second door bracket is secured flush against to an exterior surface of the door and positioned near the door handle assembly, the deadbolt assembly, or both the door handle assembly and the deadbolt assembly; and wherein an edge of the second door bracket is flush with the outside edge of the door near the door handle assembly, the deadbolt assembly, or both the door handle assembly and the deadbolt assembly;

a door frame bar comprising at least one knockout plate and comprising a plurality of holes therein for receiving a plurality of fasteners;

wherein the door frame bar is secured flush against a door frame;

wherein the at least one knockout plate is removed from the door frame bar before securing the door frame bar to the door frame to provide a knockout plate opening in the door frame bar; and wherein the door frame bar is positioned on the door frame such that the knockout plate opening is positioned over a deadbolt receiving hole in the door frame.

2. The apparatus of claim 1, wherein the at least one door hinge bar comprises a plurality of door hinge bars.

3. The apparatus of claim 1, wherein the door hinge bar is from about 1/16 inch thick to about 1/2 inch thick.

4. The apparatus of claim 1, wherein each of the first and second door brackets is less than about 1/4 inch thick.

5. The apparatus of claim 1, wherein the door frame bar is less than about 1/4 inch thick.

6. The apparatus of claim 1, wherein the plurality of fasteners for the plurality of holes of the first door bracket are wood screws or machine screws; and wherein the plurality of fasteners for the plurality of holes of the second door bracket are wood screws or machine screws.

7. The apparatus of claim 1, further comprising a reinforcing bar.

8. The apparatus of claim 1, the at least one door hinge bar has a length of about 6 inches to about 12 inches; and wherein the at least one door hinge bar has a width of about 0.25 inches to about 2 inches.

9. The apparatus of claim 1, wherein the first door bracket comprises a vertical member and a lateral protrusion.

10. The apparatus of claim 9, wherein the lateral protrusion has an ovoid shape.

11. The apparatus of claim 9, wherein the lateral protrusion has a rectangular shape.

12. The apparatus of claim 1, wherein the door frame bar has a length of about 35 inches to about 45 inches; and wherein the door frame bar has a width of about 1.5 inches to about 2.5 inches.

13. The apparatus of claim 1, wherein the at least one door hinge bar, the first door bracket, the second door bracket, and the door frame bar are made of steel.

14. A kit comprising the apparatus of claim 1 and instructions for installation of the apparatus on the door and the door frame.

* * * * *